US009335098B2

(12) United States Patent
Pawlick

(10) Patent No.: US 9,335,098 B2
(45) Date of Patent: May 10, 2016

(54) V-SHAPED HEAT EXCHANGER APPARATUS

(71) Applicant: Copper Core Limited, Toronto (CA)

(72) Inventor: Daniel R. Pawlick, Toronto (CA)

(73) Assignee: Copper Core Limited, Toronto, Ontario (CA)

( * ) Notice: Subject to any disclaimer, the term of this patent is extended or adjusted under 35 U.S.C. 154(b) by 356 days.

(21) Appl. No.: 13/795,459

(22) Filed: Mar. 12, 2013

(65) Prior Publication Data

US 2014/0262147 A1 Sep. 18, 2014

(51) Int. Cl.

| | |
|---|---|
| ***F28F 9/00*** | (2006.01) |
| ***F28F 7/00*** | (2006.01) |
| ***F28F 13/12*** | (2006.01) |
| ***F25D 19/00*** | (2006.01) |
| ***F28D 1/02*** | (2006.01) |
| ***F28D 1/04*** | (2006.01) |

(52) U.S. Cl.

CPC ..... *F28D 1/024* (2013.01); *F28D 1/0426* (2013.01); *F28F 9/001* (2013.01); *F28F 2009/004* (2013.01)

(58) Field of Classification Search

CPC ..... F28F 9/007; F04B 17/06; F28D 1/0426
USPC ..... 165/76, 78, 122, 67, DIG. 138, 146; 62/452

See application file for complete search history.

(56) References Cited

U.S. PATENT DOCUMENTS

| | | | | | |
|---|---|---|---|---|---|
| 1,620,632 | A * | 3/1927 | Broderick | 248/209 | |
| 3,384,165 | A * | 5/1968 | Mathews | 165/122 | |
| 4,149,588 | A * | 4/1979 | Waters | 165/11.1 | |
| 5,226,235 | A * | 7/1993 | Lesage | F28F 1/32 | 165/149 |
| 5,538,079 | A * | 7/1996 | Pawlick | F28D 1/05366 | 165/153 |
| 6,817,404 | B2 * | 11/2004 | Frana-Guthrie et al. | 165/43 | |
| 7,370,690 | B2 * | 5/2008 | Rasset et al. | 165/41 | |
| 7,845,413 | B2 * | 12/2010 | Shampine | E21B 43/267 | 166/105 |
| 2003/0058327 | A1 * | 3/2003 | Louis | 347/220 | |
| 2006/0219451 | A1 * | 10/2006 | Schmitt | 180/68.4 | |
| 2012/0247712 | A1 * | 10/2012 | Schertz et al. | 165/41 | |
| 2014/0056729 | A1 * | 2/2014 | Pawlick | F04B 53/08 | 417/234 |

* cited by examiner

*Primary Examiner* — M. Alexandra Elve
*Assistant Examiner* — Paul Alvare
(74) *Attorney, Agent, or Firm* — Riches, McKenzie & Herbert LLP

(57) ABSTRACT

A V-shaped heat exchanger apparatus providing a support pedestal on which on at least one side thereof a frame assembly is removably coupled to the pedestal structure. The frame assembly includes preferably as a unitary element, a frame and at least one heat exchanger fixedly secured thereto.

19 Claims, 27 Drawing Sheets

V-SHAPED HEAT EXCHANGER APPARATUS

SCOPE OF THE INVENTION

This invention relates to a heat exchanger apparatus carrying a plurality of radiators and, more particularly, to a V-shaped heat exchanger apparatus preferably for internal combustion engines as, for example, used with mobile pump units for hydraulic fractioning.

Hydraulic fractioning is a known process which requires heavy duty pumps on a mobile frac pump unit driven by an internal combustion engine typically a diesel motor. The large horsepower required to drive the pump requires significant cooling radiators be provided for the diesel motors. Heat exchanger apparatus including radiators for cooling of the diesel motors are required to be operated under difficult dusty conditions. Prior art heat exchange apparatus suffer the disadvantage that they have configurations which render them difficult to maintain and repair, often with the radiators being difficult to access for cleaning and difficult to access for repair and difficult to remove.

SUMMARY OF THE INVENTION

To at least partially overcome these disadvantages of previously known devices, the present invention provides a V-shaped heat exchanger apparatus providing a support pedestal on which on at least one side thereof a frame assembly is removably coupled to the pedestal structure. The frame assembly includes preferably as a unitary element, a frame and at least one radiator fixedly secured thereto.

An object of the present invention is to provide an improved heat exchanger apparatus having a configuration which provides for ease of maintenance and repair.

In one aspect, the present invention provides a heat exchanger apparatus including a pedestal and a frame assembly removably coupled to the pedestal wherein the frame assembly comprises an integral unit including a frame and a plurality of heat exchange units selected from air to air radiators and air to liquid radiators fixedly coupled to the frame.

In another aspect, the present invention provides a heat exchanger apparatus including a pedestal with heat exchange units such as radiators or air coolers secured therewith, the pedestal defining an interior divided into two compartments selectively open to various of the radiators and coolers and a fan control unit for controlling atmospheric air passing though each compartment.

In another aspect, the present invention provides a heat exchanger apparatus comprising:

a rigid support pedestal structure having a top, a bottom, a right side a left side, a front and a back, the pedestal structure comprising a plurality of frame members forming the pedestal structure with a substantially open interior, the frame members defining a top air flow opening through the frame members through the top, a right side air flow opening through the frame members through the right side and a left side air flow opening through the frame members through the left side, a right frame assembly removably coupled to the pedestal structure on the right side of the pedestal structure across the right side air flow opening, a left frame assembly, removably coupled to the pedestal structure on the left side of the pedestal structure across the left side air flow opening, the right frame assembly comprising a rigid right frame with peripheral right frame members defining a right opening therebetween from an interior side of the right frame to an exterior side of the right frame, the right frame assembly further comprising at least one air to liquid right radiator each mounted to the right frame across the right opening, wherein with the right frame assembly removably coupled to the pedestal structure across the right side air flow opening, air flowing through the right opening of the right frame exchanges heat with a respective fluid within each right radiator, the left frame assembly comprising a rigid left frame with peripheral left frame members defining a left frame opening therebetween from an interior side of the left frame to an exterior side of the left frame, the left frame assembly further comprising at least air to liquid left radiator each mounted to the left frame across the opening for air flow through the left frame opening to exchange heat with a respective fluid within each left radiator, wherein with the left frame assembly removably coupled to the pedestal structure across the left side air flow opening, air flowing through the left opening of the left frame exchanges heat with fluid within each left radiator, wherein without disassembly of the pedestal structure, the right frame assembly, as an integral unit including the right frame with each right radiator fixedly secured to the right frame, is removable from and couplable to the pedestal structure, wherein without disassembly of the pedestal structure, the left frame assembly, as an integral unit including the left frame assembly with each left radiator fixedly secured to the left frame assembly, is removable from and couplable to the pedestal structure.

BRIEF DESCRIPTION OF THE DRAWINGS

Further aspects and advantages of the present invention will become apparent from the following description taken together with the accompanying drawings in which.

DETAILED DESCRIPTION OF THE DRAWINGS

Figure 1:
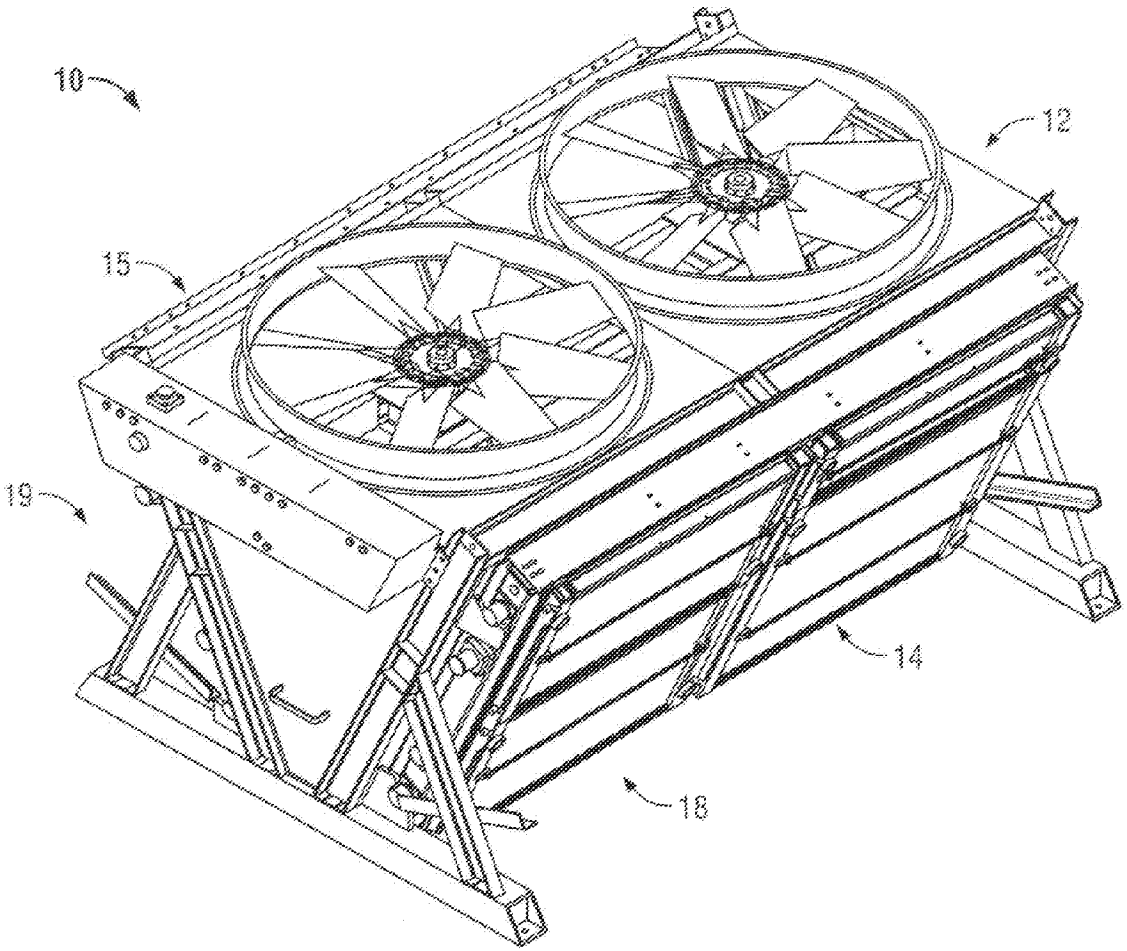
FIG. 1 is a perspective view of a heat exchanger apparatus in accordance with a first embodiment of the present invention.
Figure 2:
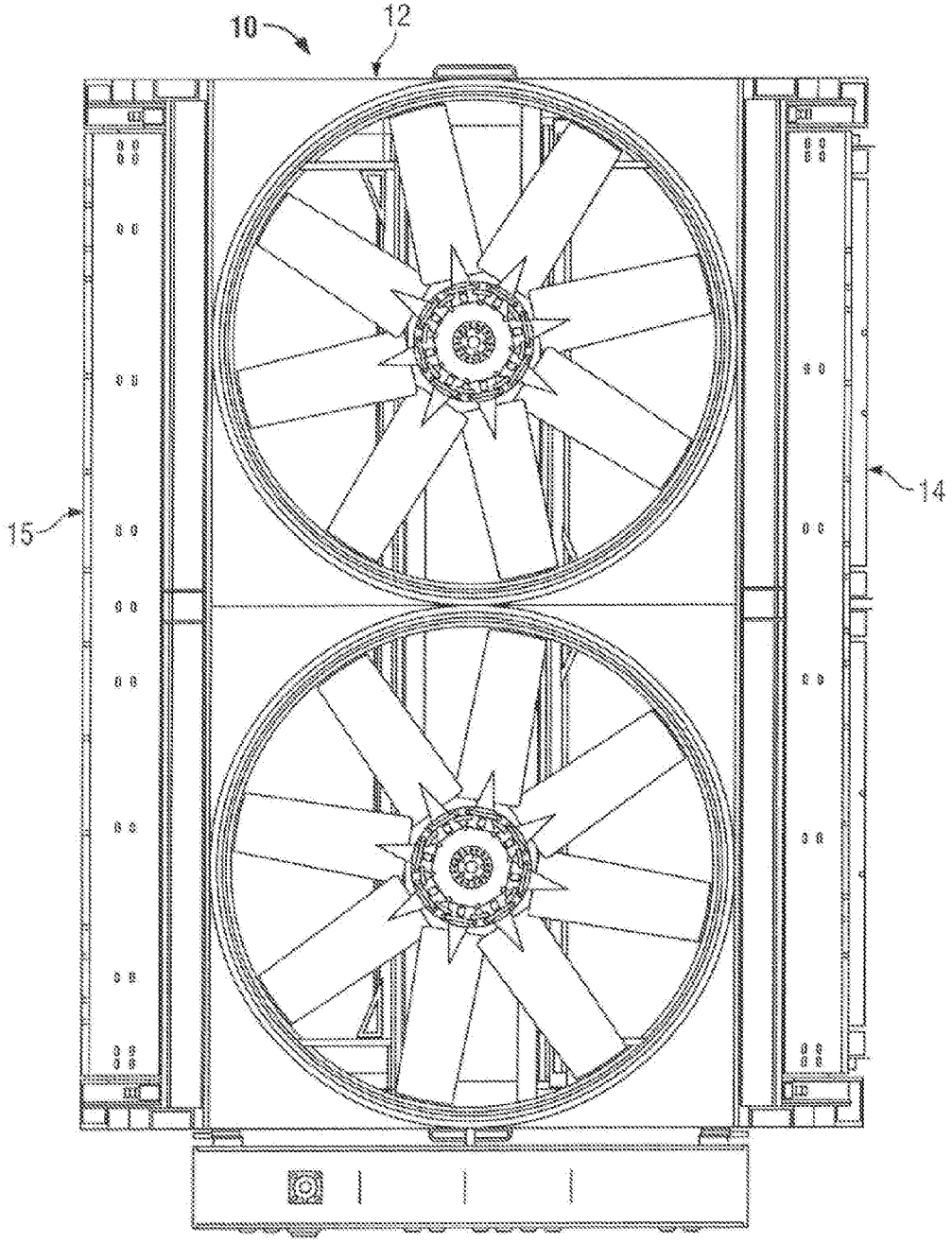
FIGS. 2, 3, 4 and 5 are respectively a top view, a left side view, a front view and a right side view of the heat exchanger apparatus shown in FIG. 1.
Figure 3:
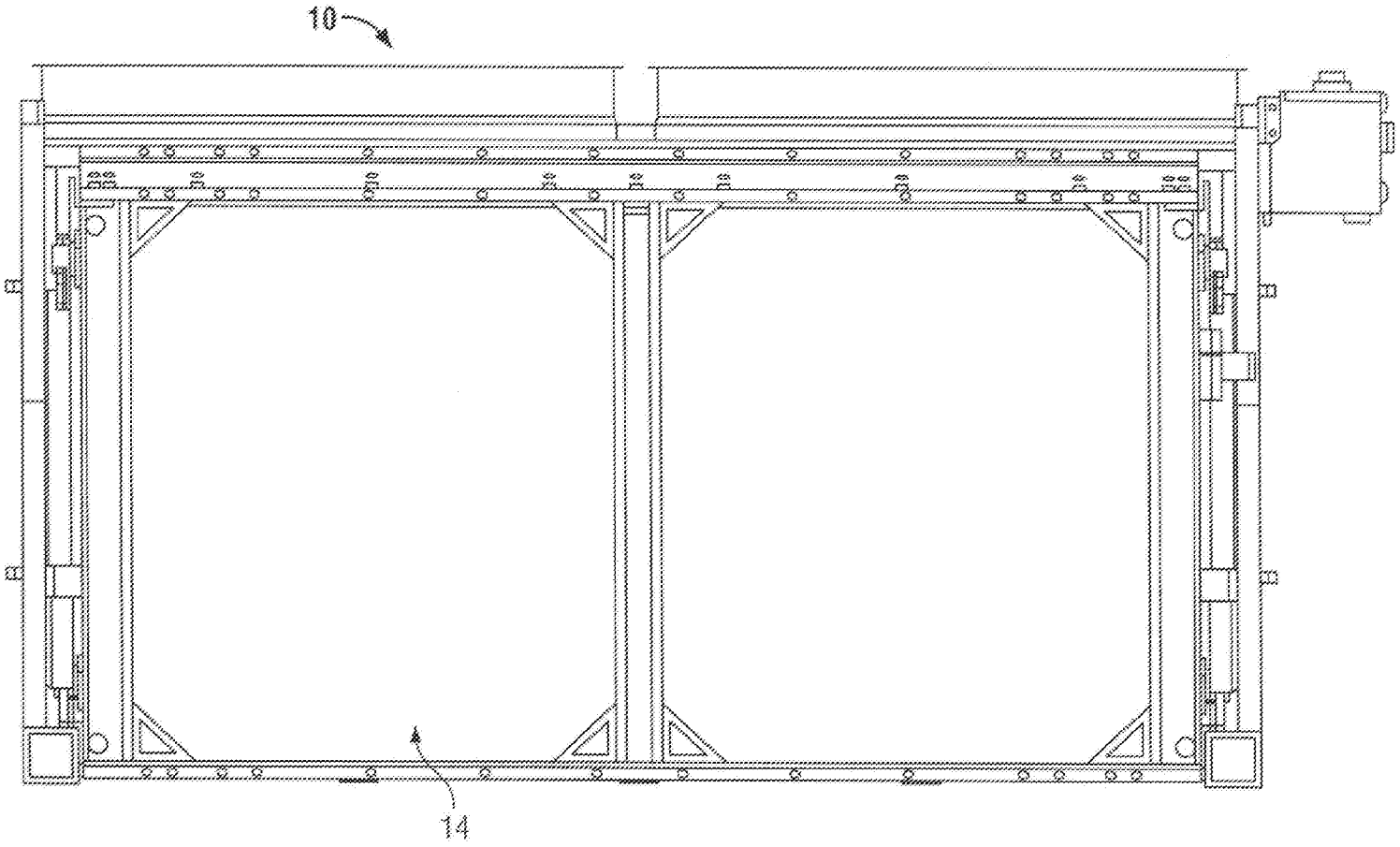

Reference is made to FIGS. 7 to 11 which show the support pedestal structure 12 as having a top 16, a bottom 17, a right side 18, a left side 19, a front 20 and a back 21. The pedestal structure 12 comprises a plurality of frame members forming the pedestal structure with a substantially open interior 22. These frame members are elongate structural members and include:

i) a right side top frame member 23;
ii) a right side rear frame member 24;
iii) a right side bottom frame member 25;
iv) a right side front frame member 26;
v) a right side middle frame member 27;
vi) a left side top frame member 28;
vii) a left side rear frame member 29;
viii) a left side bottom frame member 30;
ix) a left side front frame member 31;
x) a left side middle frame member 32;
xi) a front bottom frame member 33;
xii) a rear bottom frame member 34;
xiii) a right front strut member 35;
xiv) a right rear strut member 36;
xv) a left front strut member 37;
xvi) a left rear strut member 38;
xvii) a top front frame member 39;
xviii) a top rear frame member 40;
xix) a top middle frame member 41;
xx) a top right fan support frame member 42
xxi) a top left fan support frame member 43.

The frame members 23, 24, 25, 26 and 27 form a rectangular right side cage 50. The frame members 28, 29, 30, 31 and 32 form a rectangular left side cage 51. The right side cage 50 and left side cage 51 are carried on the support pedestal structure 12 disposed at an angle to the vertical and joined at their upper ends by the frame members 39, 40 and 41 and at their bottoms by front and rear bottom plates 44 and 45. Each of the right side cage 50 and the left side cage 51 are mounted at their bottom to the horizontally extending front and rear bottom frame members 33 and 34. At the front 20, the right side cage 50 and the left side cage 51 are rigidly supported with the right and left front strut members 35 and 37 extending between the front bottom frame member 33 and the respective of the right side and left side front frame members 26 and 31. Similarly at the back 21, the right side cage 50 and the left side cage 51 are rigidly supported with the right and left rear strut members 36 and 38 extending between the rear bottom frame member 34 and the respective of the right side and left side rear frame members 24 and 29. The right and left top fan support frame members 42 and 43 are bridged together by a front axle horizontal support plate 52 and a rear axle horizontal support plate 53 each adapted to support fan motor to drive a vertically extending fan drive shaft 62 seen in FIG. 6.

Figure 7:
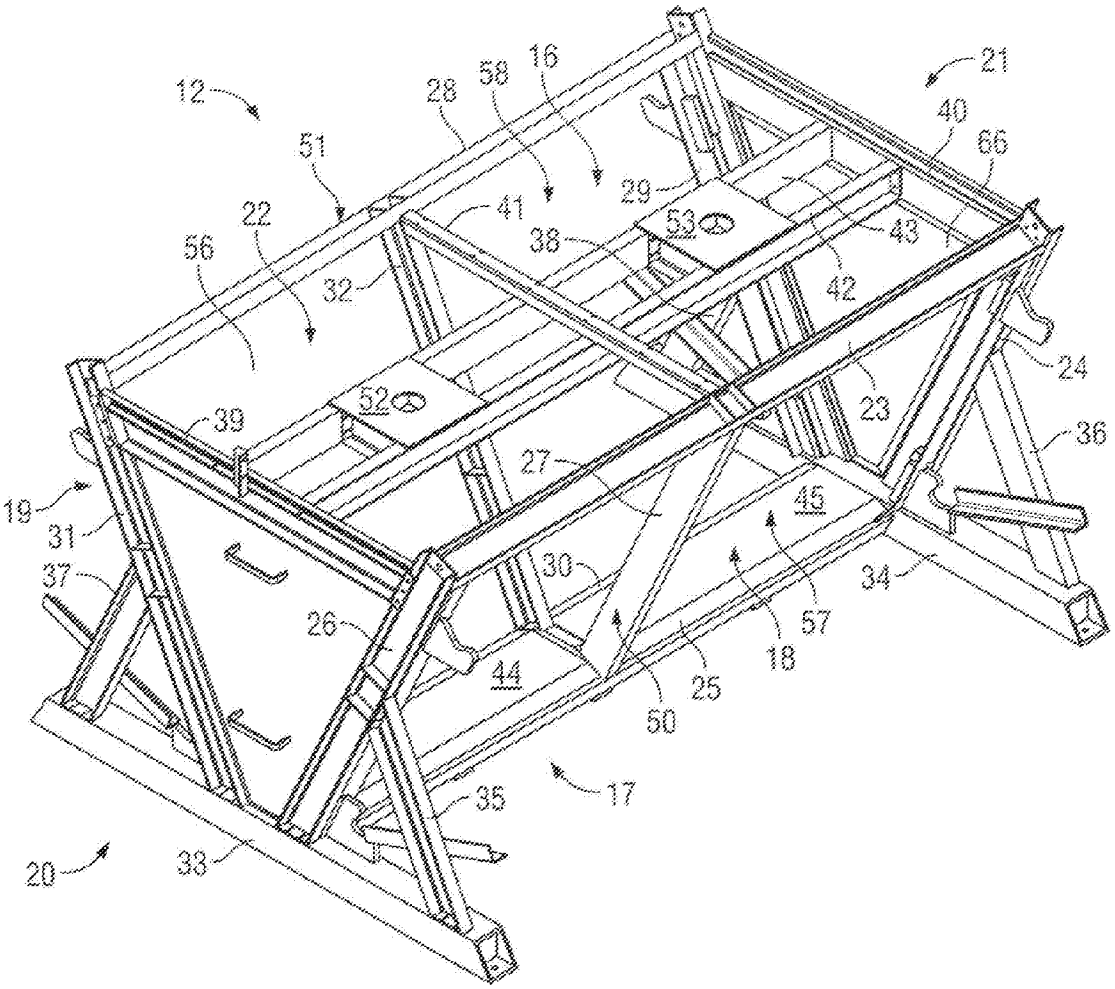
FIG. 7 is a perspective view of a support pedestal structure of the heat exchanger apparatus of FIG. 1.
Figure 8:
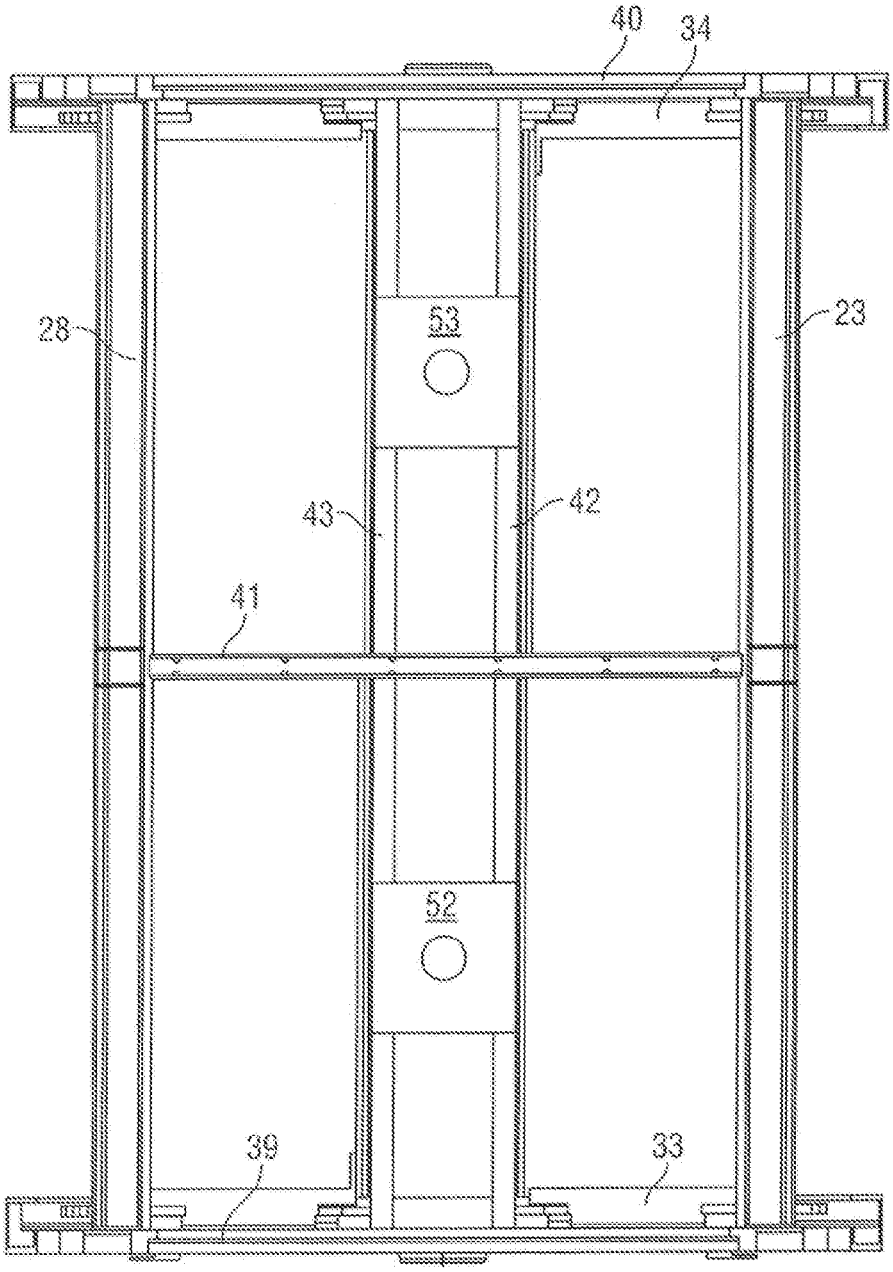
FIGS. 8, 9, 10 and 11 are respectively a top view, a left side view, a front view and a right side view of the support pedestal structure of FIG. 7.
Figure 9:
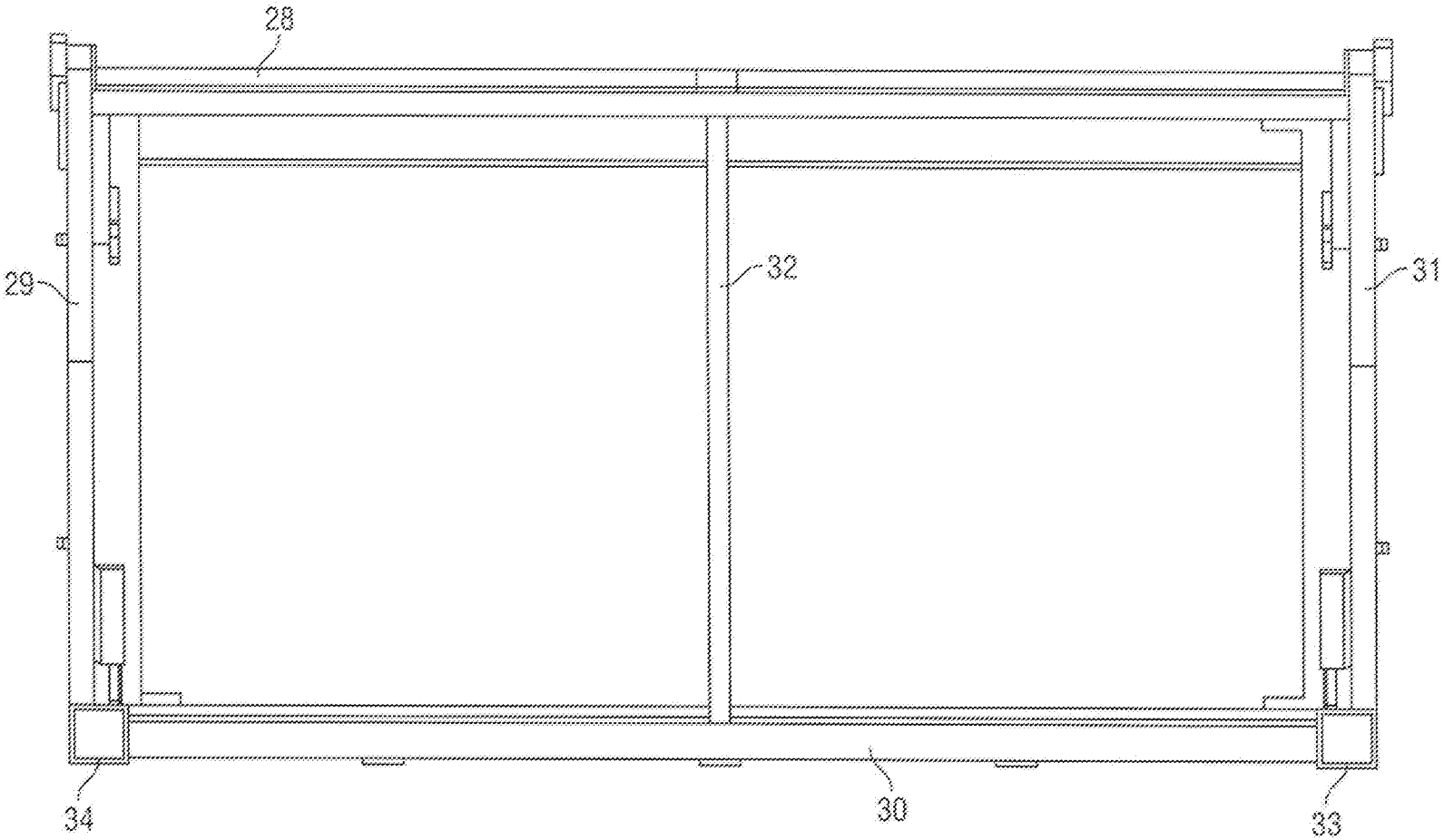
Figure 10:
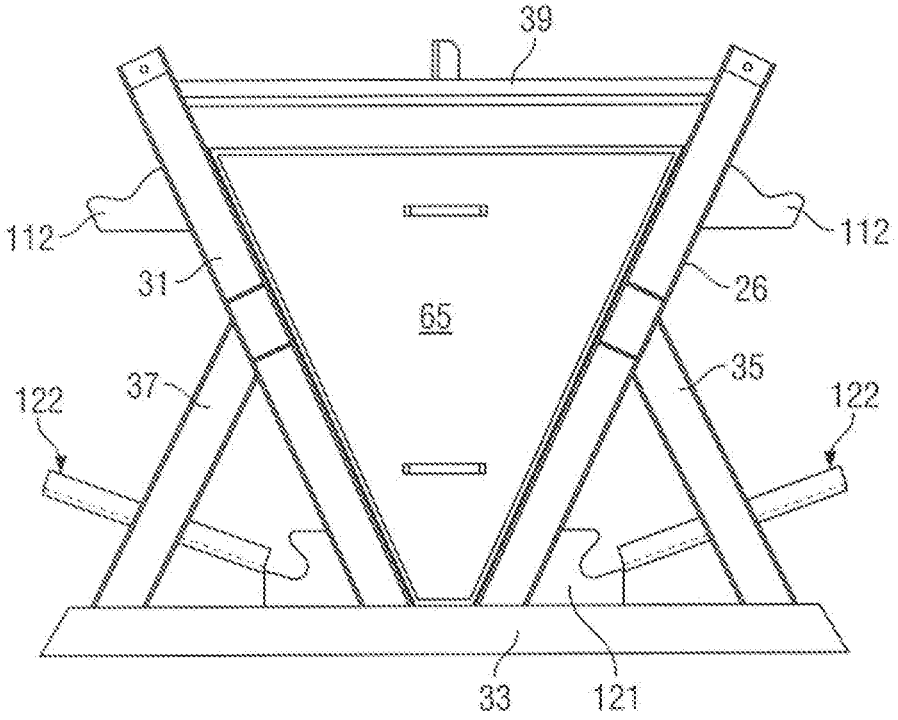
Figure 11:
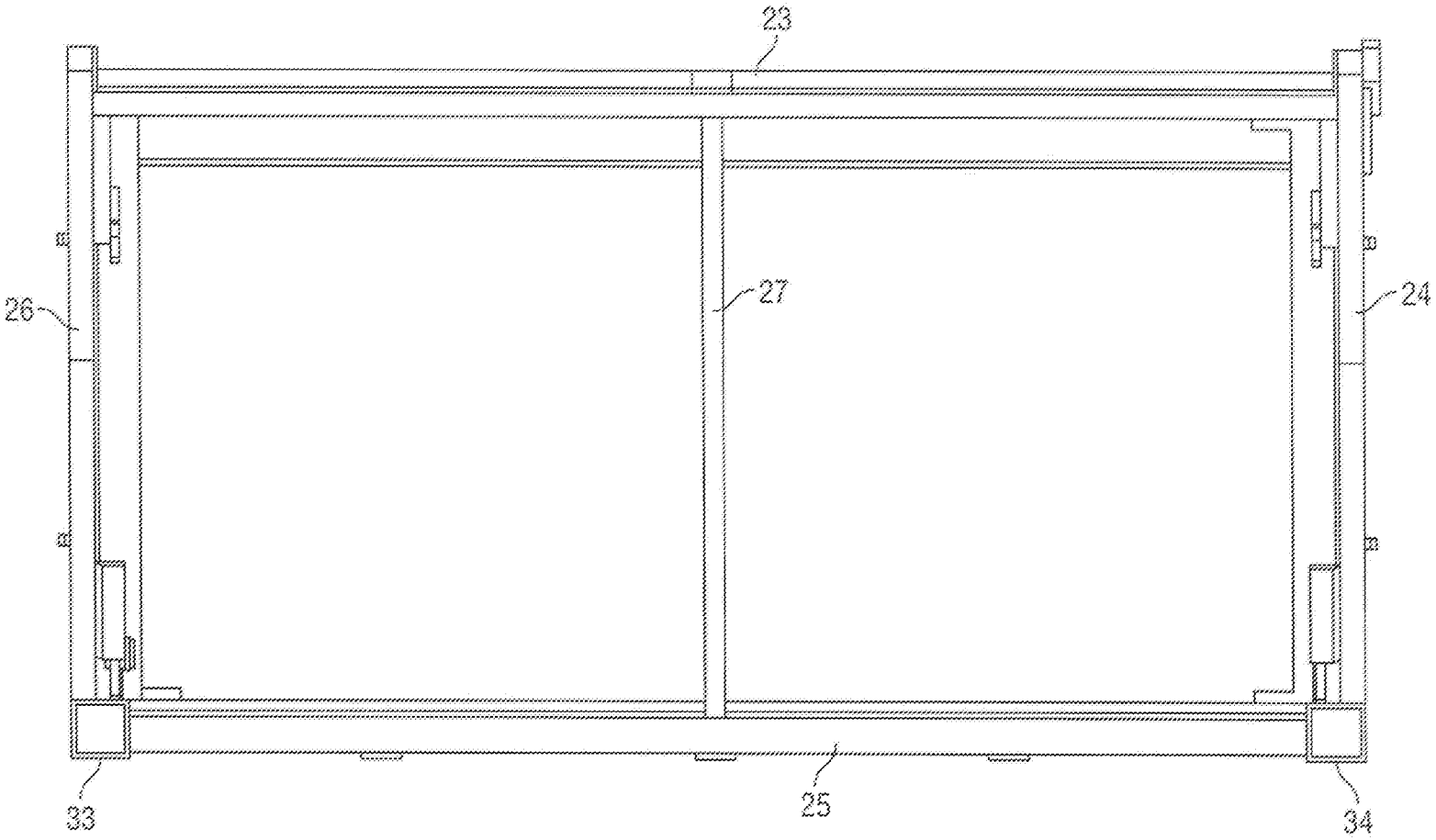

As can be best seen in FIG. 7, the pedestal structure 12 as formed by its various elongate frame members form an open matrix about the substantially open interior 22. At the top 16, the frame members define a top air flow opening 56 defined within of the top frame members 23, 39, 28 and 40. On the right side 18 of the support pedestal structure 12, there is defined a right side air flow opening 57 within the right side frame members 23, 24, 25 and 26. Similarly, on the left side 19 of the pedestal structure 12, there is defined a left side flow opening 58 defined within the left side frame members 28, 29, 30 and 31. The right side air flow opening 57 is through the right side cage 50. The left side air flow opening 58 is through the left side cage 51.

Figure 6:
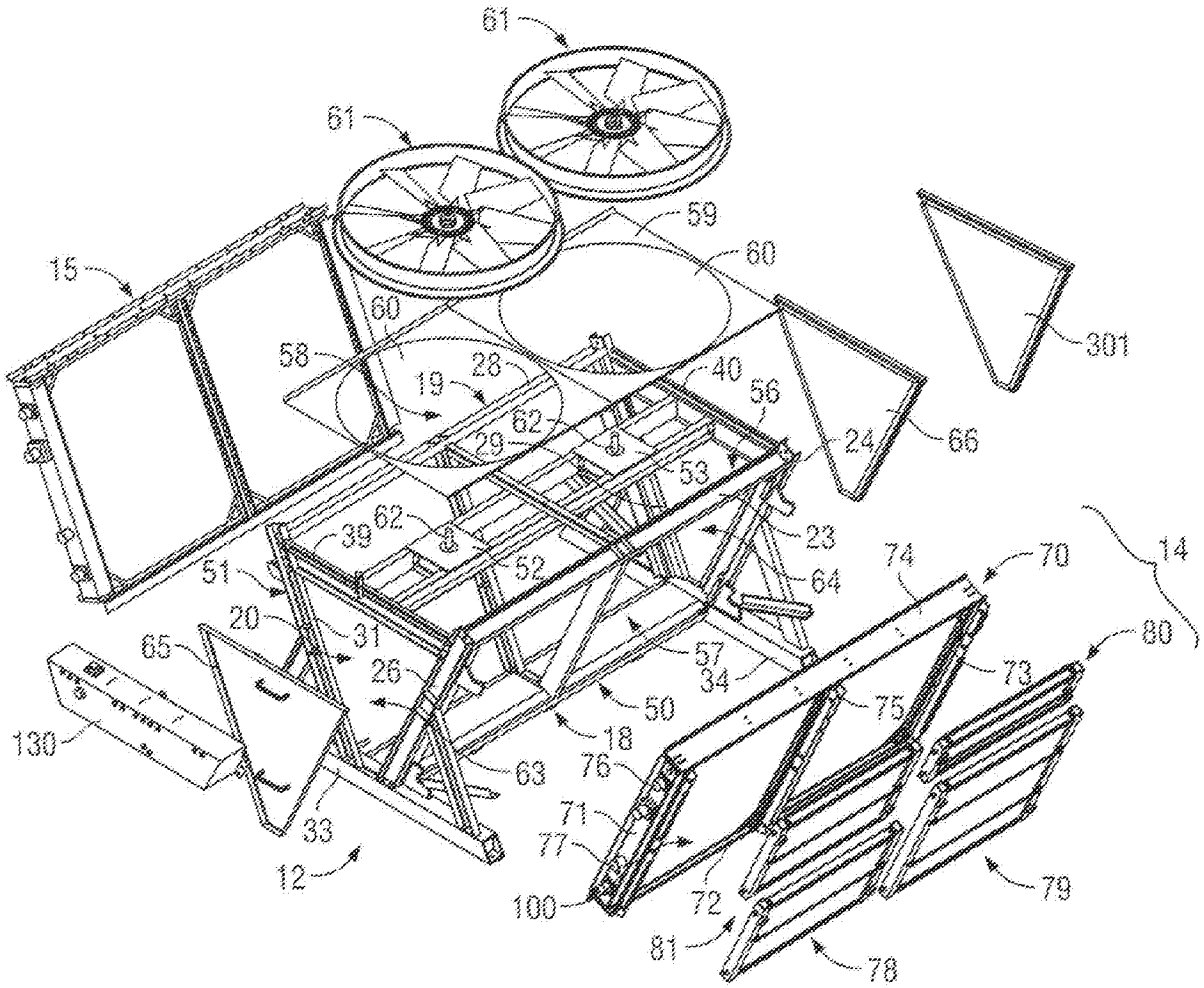
FIG. 6 is a schematic exploded pictorial view of the heat exchanger apparatus of FIG. 1.

As can be best seen in FIGS. 1 and 6, a right frame assembly 14 is removably coupled to the pedestal structure 12 on the right side 18 of the pedestal structure 12 overlying the right side cage 50 across the right side air flow opening 57. A left frame assembly 15 is removably coupled to the pedestal structure 12 on the left side 19 of the pedestal structure 12 overlying the left side cage 51 across the left side air flow opening 58.

Referring to FIG. 6, a flat planar air vent cover 59 is secured to the top frame members 23, 40, 28 and 39 with the air vent cover 59 having two circular fan duct openings 60 therethrough. A pair of air moving fans 61 is mounted on the vertical drive axles 62 supported on the front and rear axle support plates 52 and 53.

The front 20 of the pedestal structure 12 has a front opening 63 defined between the front frame members 26, 39, 31 and 33. The back 21 of the pedestal structure 12 has a rear opening 64 defined between the rear frame members 24, 40, 29 and 34. A front access door 65 is removably secured to the front frame members 26, 39, 31 and 33 to close the front opening 63 against air flow therethrough. The front access door 65 has a pair of handles to assist in removal of the front access door 65 as may be desired to provide access through the front opening 63 into the interior 22. Similarly, a rear access door 66 is removably secured to the rear frame members 24, 40, 29 and 34 when in place to close the rear opening 64 against air flow therethrough and if removed to provide access through the rear openings 64 into the interior 22. FIG. 6 also shows an optional middle panel 301 which can be secured to close the opening between the right side middle frame member 27, the left side middle frame member 32 and the top middle frame member 41 as in the embodiment of FIG. 25.

Figure 4:
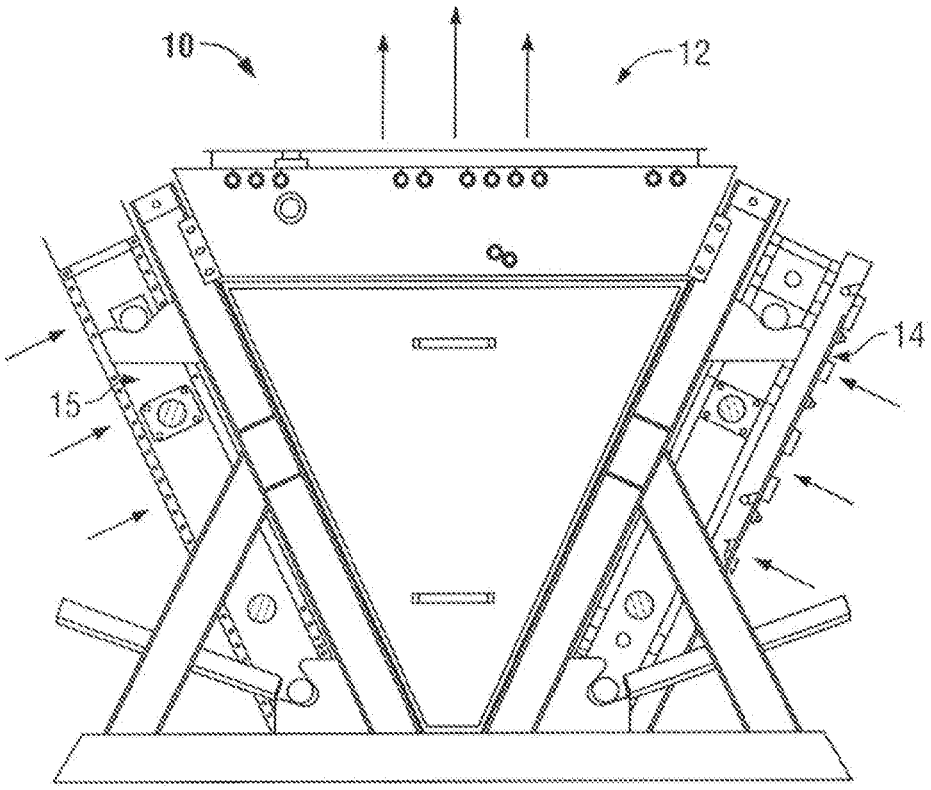
Figure 5:
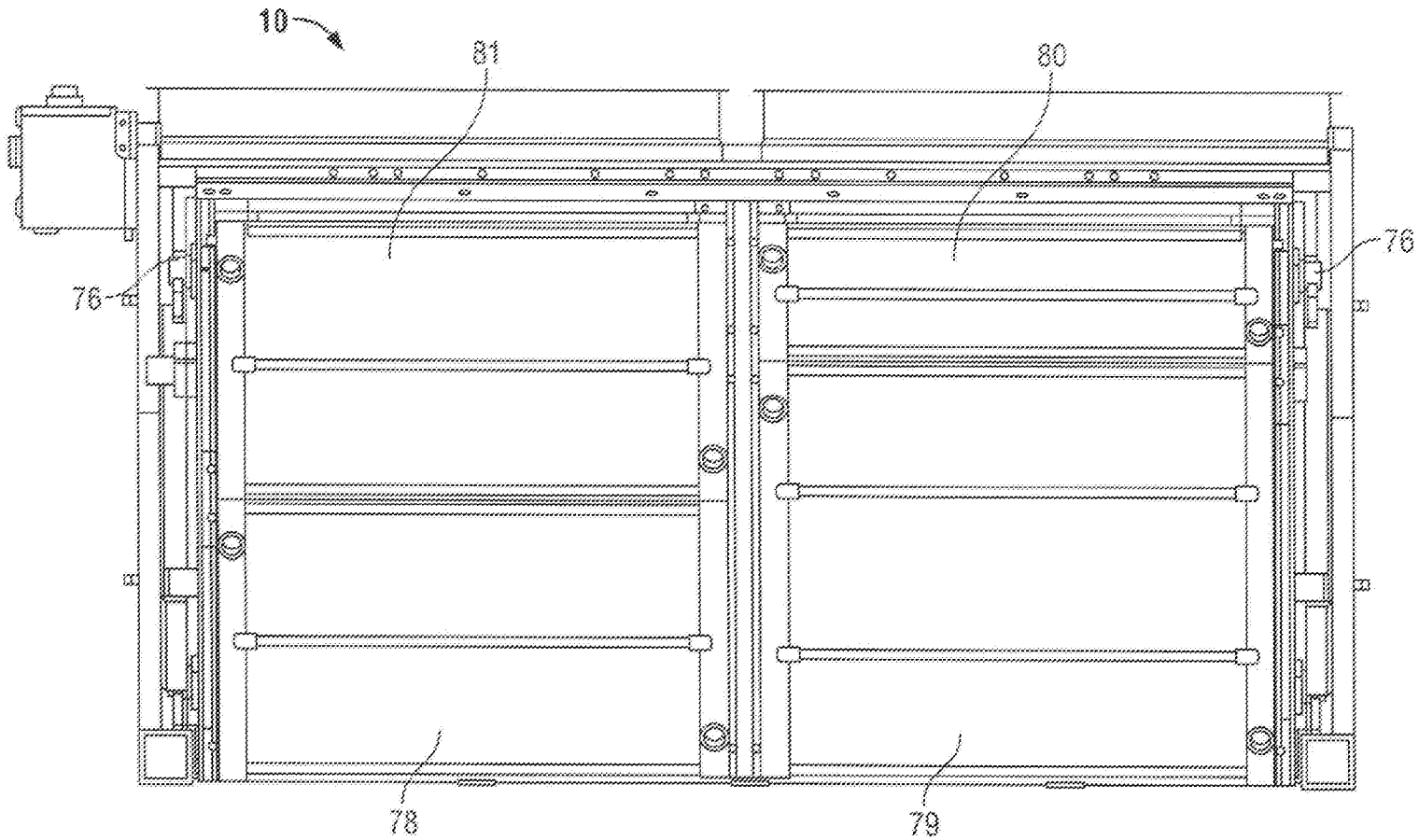

Reference is made to FIG. 4 which illustrates as schematically indicated by arrows a preferred manner of air flow through the heat exchanger apparatus 10, that is, with atmospheric air drawn in on the right side 18 through the right frame assembly 14 and on the left side 19 through the left frame assembly 15 into the interior and out the top 16. As seen in FIG. 6 each of the fans 61 are rotated so as to draw air upwardly from the interior 22 through the top air flow opening 56 by drawing air through the fan duct openings 60 in the air vent cover 59.

In the assembled heat exchanger apparatus 10, the front opening 63 is closed by the front access door 65, the rear access opening 64 is closed by the rear access door 66 and the bottom 17 is closed between the right side cage 50 and the left side cage 51 by the front and rear bottom plates 44 and 45. The right frame assembly 14 is coupled across the right side air flow opening 57 and the left frame assembly 15 is coupled across the left side air flow opening 58. With the operation of the fans 61 drawing air upwardly from the interior 22 through the top air flow opening 56, air is simultaneously drawn from the atmosphere through the right frame assembly 14 via the right side air flow opening 57 into the interior 22 and through the left frame assembly 15 via the left side air flow opening 58 into the interior 22.

As can be seen in FIG. 6, the right frame assembly 14 includes a rigid rectangular right frame 70 formed from a plurality of elongate frame members including a front frame member 71, a bottom frame member 72, a rear frame member 73, a top frame member 74 and a middle frame member 75. The front frame member 71 has a front upper guide member 76 fixedly secured thereto in the form of a cylindrical rod which extends forwardly therefrom along an upper longitudinal axis parallel to the top frame member 74. The right frame member 71 also has a front lower guide member 77 fixedly secured thereto also in the form of a cylindrical rod extending forwardly therefrom along a lower longitudinal axis parallel to the upper longitudinal axis. Similarly, the rear frame member 73 has a similar rearwardly extending rear upper guide member 76 in the form of a cylindrical rod which extends rearwardly therefrom along the upper longitudinal axis and a similar rearwardly extending rear lower guide member in the form of a cylindrical rod which extends rearwardly therefrom along the lower longitudinal axis.

Figure 13:
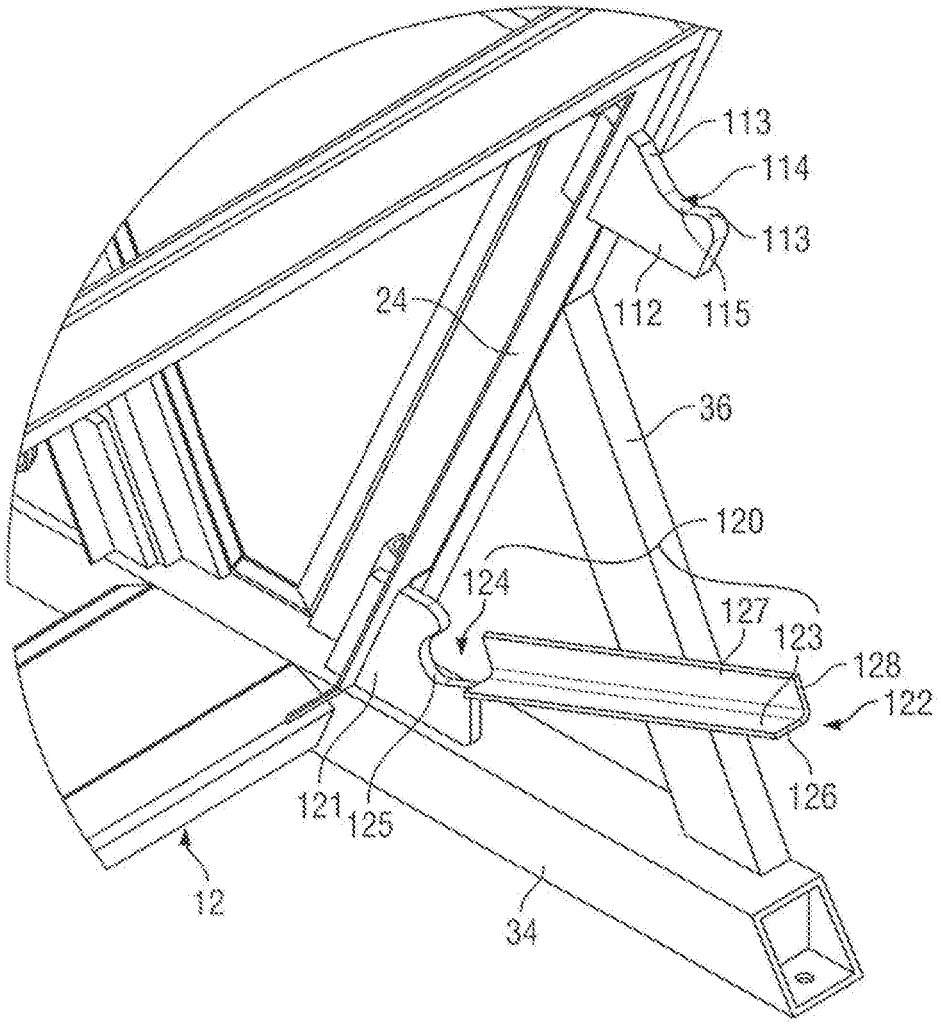
FIG. 13 is an enlarged perspective view of a lower rear corner of the support pedestal structure in FIG. 7.

Reference is made to FIG. 13 which shows an enlarged pictorial view of the rear of the pedestal structure 12. An upper rear guide arm 112 is secured to the right side frame member 24 and presents an upwardly directed camming surface 113 including an upwardly opening upper recess 114 with registry surfaces 115 which are complementary to and are provided for engagement with the rear upper guide member 78. A lower rear right guide arm structure 120 is shown in FIG. 13 including a vertically disposed plate 121 and an elongate guiding member 122 which is L-shaped in cross-section and has, in cross-section, a horizontal arm 126 and a vertical arm 128. The lower rear right guide arm structure 120 presents an upwardly directed camming surface 123 including an upwardly opening lower recess 124 with registry surfaces 125 which are complementary to and are provided for engagement with the rear lower guide member 77. The lower recess 124 and its registry surfaces 125 are provided in the vertically disposed plate 121. The upwardly directed camming surface 123 is formed by an upwardly directed surface of a horizontal arm 126 of the guiding member 122 which angles downwardly towards the left into the lower recess 124. A horizontally directed camming surface 127 is formed by a forwardly directed surface of a vertically extending arm 128 of the guiding member 122.

Figure 21:
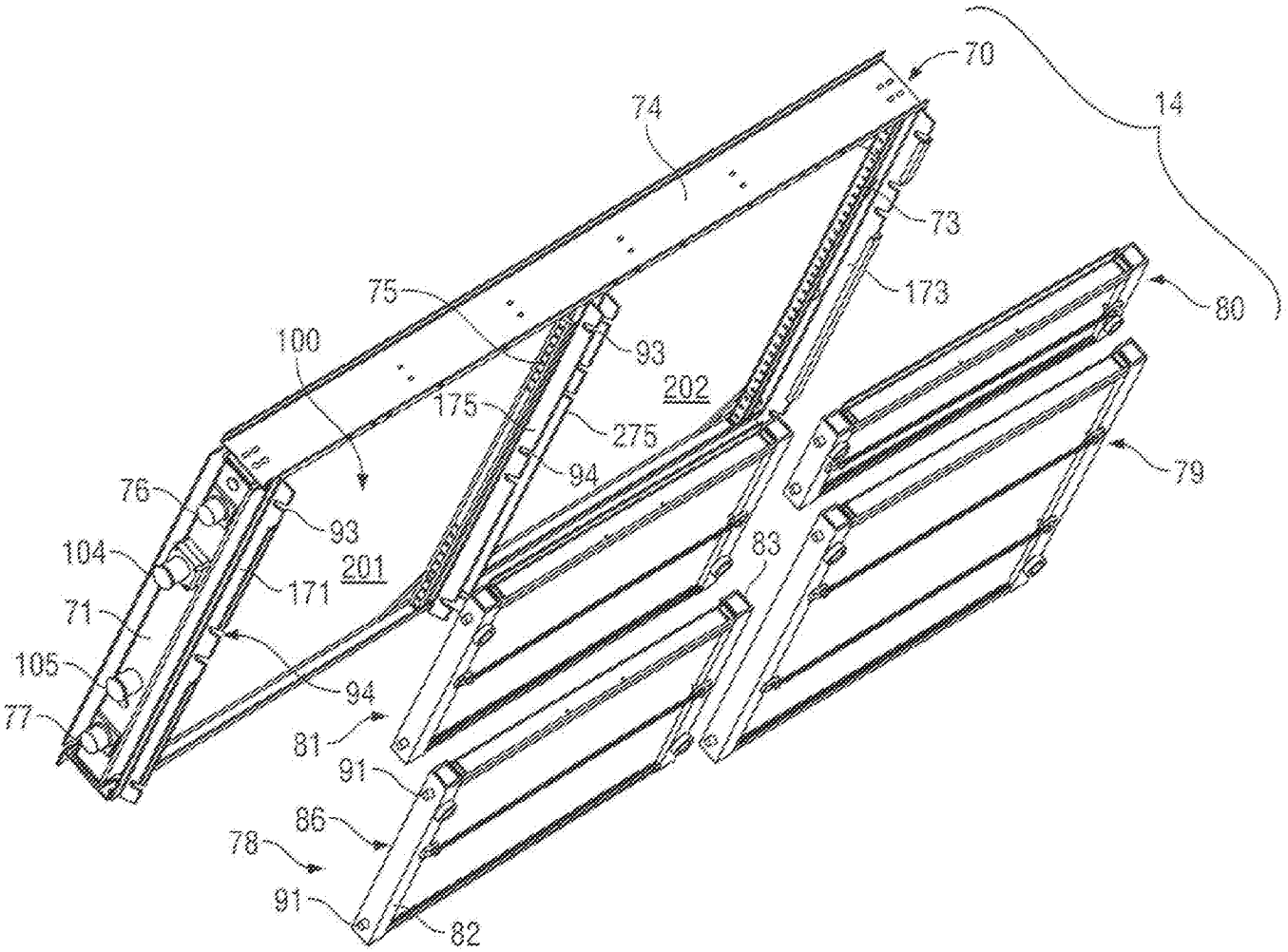
FIG. 21 is a schematic exploded pictorial view showing the exterior right side of the right frame assembly of FIG. 6 enlarged.
Figure 22:
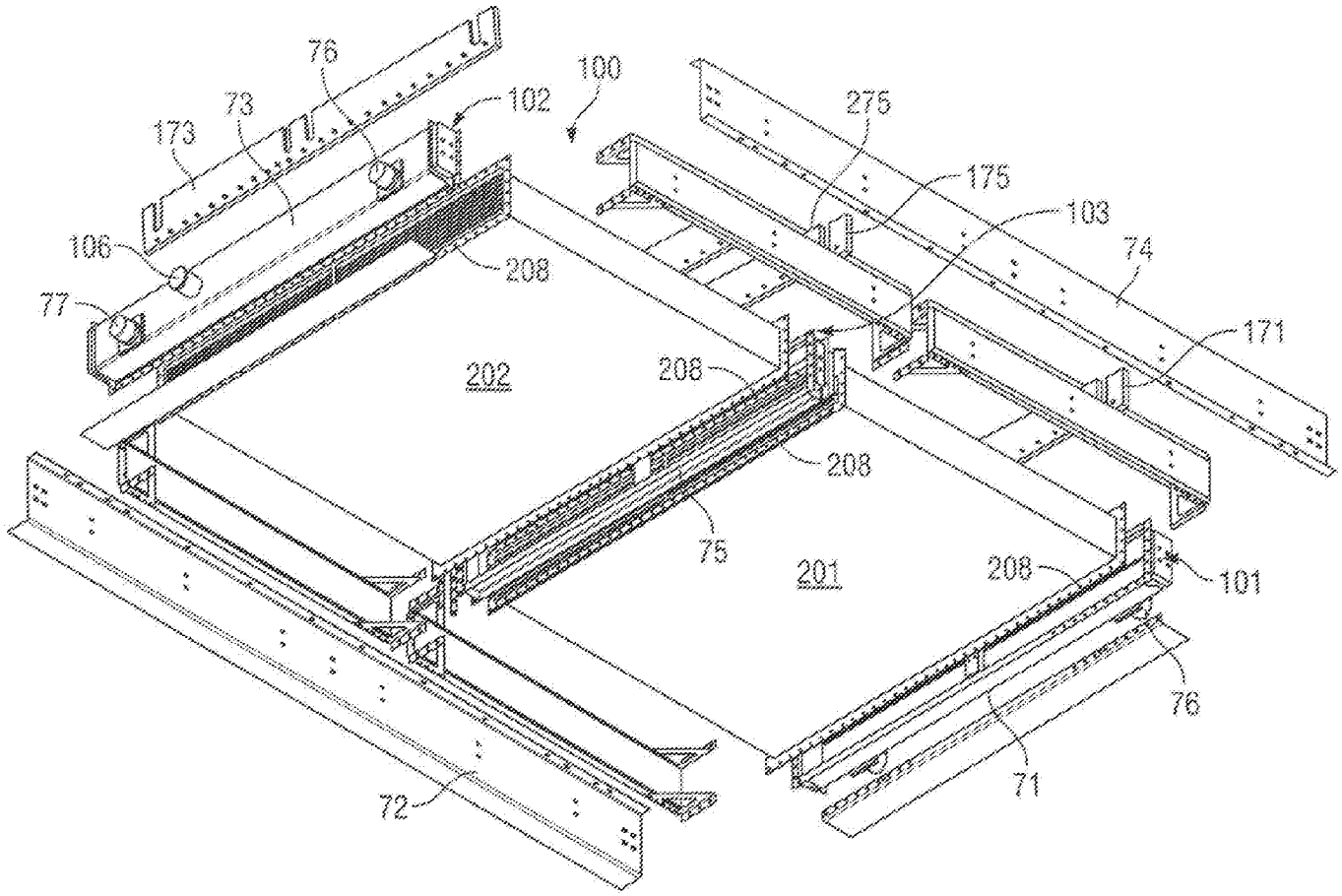
FIG. 22 is a schematic exploded pictorial view showing the interior, left side of the right interior radiator shown in FIG. 21.
Figure 23:
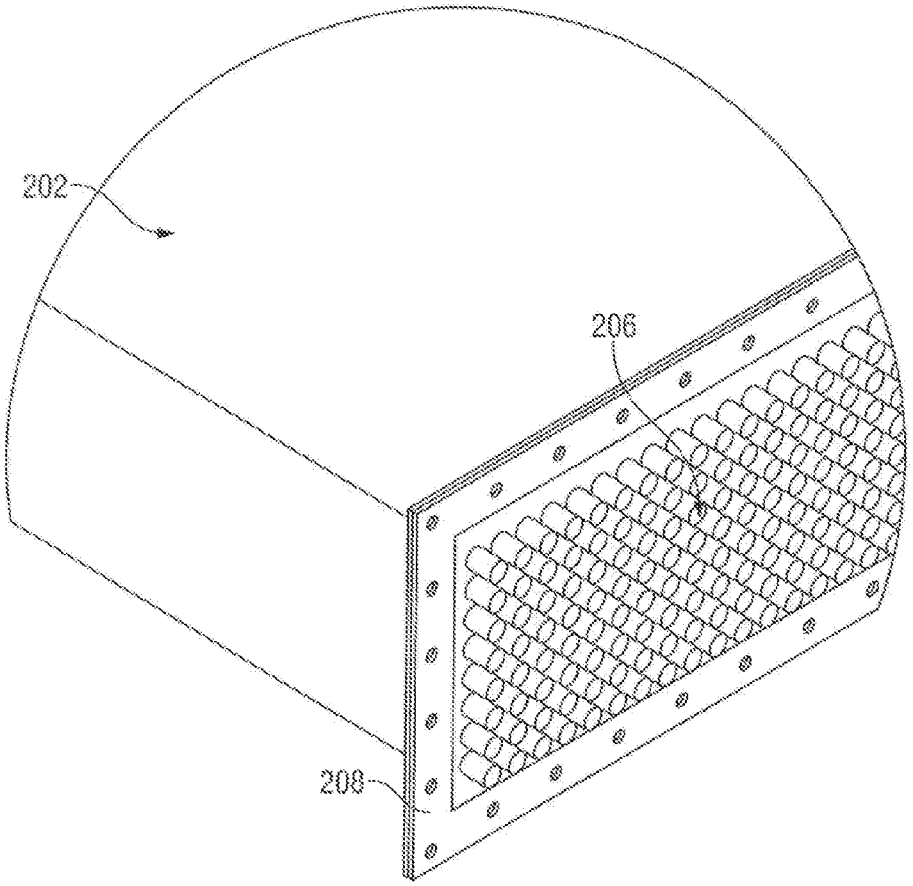
FIG. 23 is an enlarged perspective view of a lower front corner of one core of the radiator shown in FIG. 22.

As seen in FIGS. 6 and 21, the right frame assembly 14 carries five radiators namely one interior radiator 100 and four exterior radiators 78, 79, 80 and 81. The right frame 70 carries the right interior radiator 100. As best seen in FIG. 22, the radiator 100 has a front tank 101, a rear tank 102 and a center tank 103. The radiator 100 has a front core 201 and a rear core 202. The front core 201 extends between the front tank 101 and the center tank 103. The rear core 202 extends between the center tank 103 and the rear tank 202. In the Figures, the core 201 and 202 are schematically shown as rectangular boxes for ease of illustration. FIG. 23 is an enlarged schematic view of one end of the core 202. On FIG. 23, the core 202 comprises a bank of horizontally extending spaced cooling tubes 206 which are sealably coupled near each of their ends to a header plate 208 such that the bank of tubes 206 extend between a pair of such header plates 208. Each header plate 208 is to be sealably removably secured to a respective of the tanks 101, 102 and 103 as with a sealing gasket not shown therebetween. FIG. 23 schematically illustrates one corner of the rear core 202 from which there can be seen a short end section of each of the tubes 206 as extending through the header plate 208. The particular construction of the header plate 208 may be analogous to that illustrated in U.S. Pat. No. 5,226,235 to Lesage, issued Jul. 13, 1993 and U.S. Pat. No. 5,538,079 to Pawlick, issued Jul. 23, 1996 as with resilient grommets disposed about each tube sealably engaging each tube 206 in the respective header plate 208. While not shown for ease of illustration of each core, preferably a plurality of cooling fins may be disposed between the tubes to increase the surface area for heat exchange with air passing through the core. While not shown, preferably, each core 201 and 202 includes cooling fins provided to extend transversely to the cooling tubes.

The front tank 101 is shown as provided with two fluid inlet ports 104 and 105 and a fluid inlet port 106 is provided on the rear header 102. In a known manner, fluid is directed into the fluid inlets 104 and 105 and passes from the front tank 101 through the front core 201 to the middle tank 103 from the middle tank 103 to the rear core 202, through the middle tank 103, through the rear core 202 to the rear tank 102 and then exits the rear tank from the fluid outlet port. In such a configuration, the right interior radiator 100 is configured as a single pass heat exchanger. Of course, that the radiator is a single pass is not necessary. The radiator could be a double pass heat exchanger with both the inlet ports and the outlet ports being provided on the front header, for example.

The fluid inlet ports 104 and 105 and the fluid outlet port 106 are adapted to be removably connected with cooling fluid inlet tubes and a cooling fluid outlet tube, not shown, to a circulating pump not shown such that a cooling liquid may be circulated between the tanks 101 and 102 through tubes 206 of the cores 201 and 202. In a known manner, air passages are provided through the right interior radiator 100 through the cores 201 and 202 between the tubes 206 and past the tubes 206 such that with air flow through the right interior radiator 100, there may be an exchange of heat between air passing therethrough and fluid within the cores 201 and 202 of the right interior radiator 100.

The right interior radiator 100 is secured to the right frame 70 within the right frame 70 with the front tank 101 comprising the front frame member 71, the rear tank 102 comprising the rear frame member 73, and the middle tank 103 comprising the middle frame 75 with each of the front frame member 71, rear frame member 73 and middle frame member 75 secured at their top to the top frame member 74 and at their bottom to the bottom frame member 72.

The right interior radiator 100 which is formed as by the tanks 101, 103 and 102 and the cores 201 and 202, is carried on the right frame 70 disposed on an interior side of the right frame 70 as contrasted with the exterior radiators 78, 79, 80 and 81 which are disposed outwardly on an exterior side of the right frame 70 to the right of the right interior radiator 100. Air flow from the atmosphere through the frame assembly 14 into the interior 22 passes through the exterior radiators 78, 79, 80 and 81 before passing through the interior radiator 100, at least where the exterior radiators 78, 79, 80 and 81 overlie the interior radiator 100.

Figure 24:
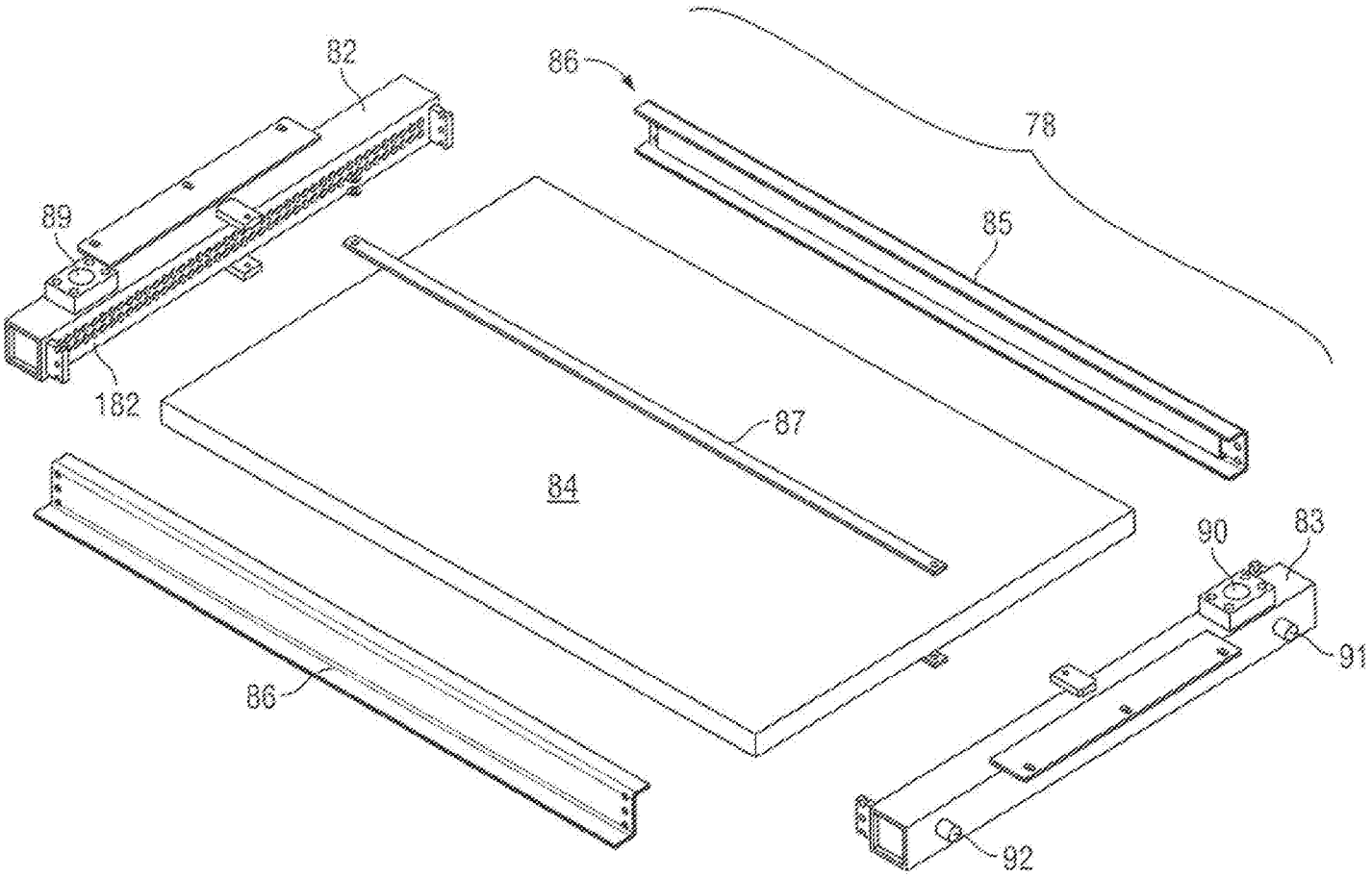
FIG. 24 is an exploded pictorial view showing the exterior, right side of a right exterior radiator mounted to the exterior of the right interior radiator shown in FIG. 21.
Figure 25:
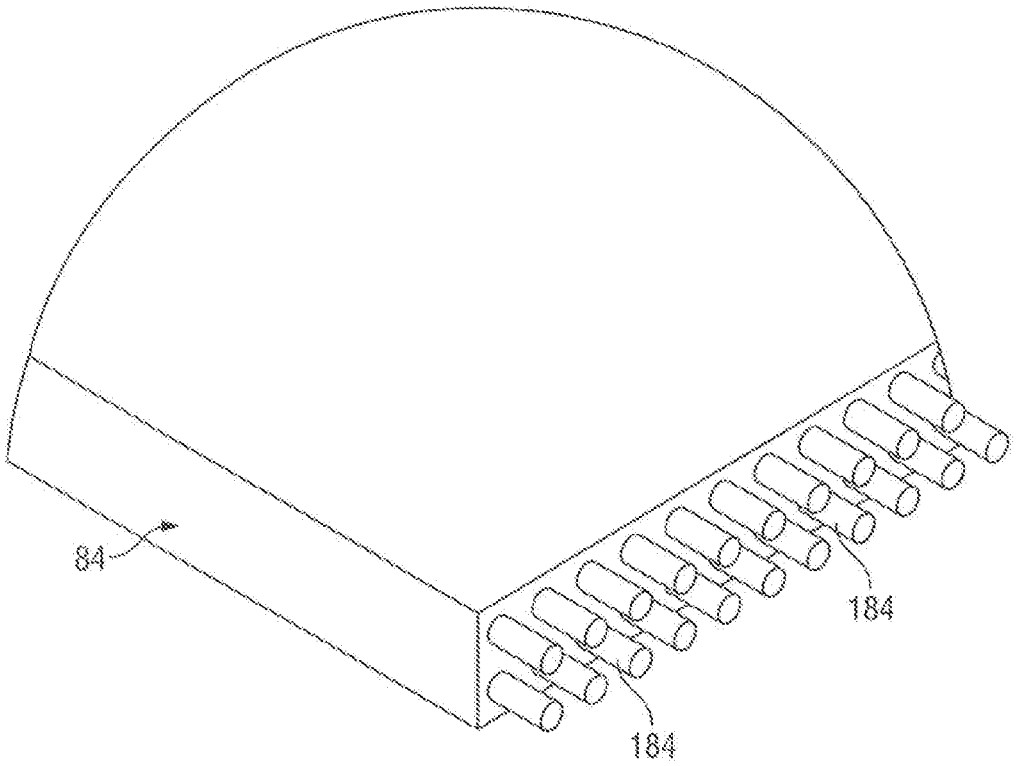
FIG. 25 is an enlarged perspective view of a lower rear corner of the core in FIG. 24.

The external radiator 78 is exemplary of the other radiators 79, 80 and 81. The external radiator 78 is best seen in FIGS. 24 and 25. External radiator 78 has a front tank 82 and a rear tank 83 with the core 84 extending between the front tank 82 and the rear tank 83. The core 84 is schematically shown as a rectangular box. One corner of the core 84 is schematically illustrated in FIG. 25 as including a plurality of horizontally extending tubes 184. The front tank 82 has a front header plate 182 with an array of holes therethrough such that each of the tubes 184 of the core 84 is sealably received in a corresponding hole. Similarly, the rear tank 83 has a rear header plate (not shown) with an array of holes therethrough such that each tube 184 of the core 84 is sealably received in a respective hole. Preferably, the sealable connection of the tubes 184 to the header plates may be the same as that described in U.S. Pat. No. 5,226,235 to Lesage, issued Jul. 13, 1995, the disclosure of which is incorporated herein by reference. Preferably, the core 84 includes cooling fins, not shown, provided in contact with the tubes 184 to increase the area for heat transfer with air passing through the core. The fins may be, for example, plates extending perpendicular to the tubes or otherwise.

The external radiator 78 includes a top radiator frame member 85 and a bottom radiator frame member 86 connected structurally at either end to the tanks 82 and 83 to form a rigid radiator frame 86 of the external radiator 78 and structurally assisted by a side rail 87 extending between the middle of the front tank 82 and the middle of the rear tank 83. The external radiator 78 is provided with a fluid inlet port 89 on the front tank 82 and a fluid outlet port 90 on the rear tank 83 adapted to be removably connected with, respectively, a cooling fluid inlet tube and a cooling fluid outlet tube, neither of which is shown, to a circulating pump not shown such that a cooling liquid may be circulated from the front tank 82 to the rear tank 83 through tubes 184. In a known manner, air passages are provided through the core 84 of the external radiator 78 internal of the radiator frame 86 and past the tubes 184 such that with air flow through the external radiator 78, there may be an exchange of heat between air passing therethrough and fluid within the core 84 of the external radiator 78.

The external radiator 78 has carried on its front tank 82 a pair of vertically spaced forwardly extending mounting studs 91 and 92 and a similar pair of such mounting studs 91 and 92 are carried on and extend rearwardly from the rear tank 83.

As seen in FIG. 21, the front frame member 71 carries a front mounting flange 171 which extends to the right on the exterior side of the front tank 101 forming the front frame member 72 of the right frame 70. The rear frame 93 carries a rear mounting flange 173 which extends to the right on the exterior side of the rear tank 102 forming the rear frame member 73 of the right frame 70. Similarly, the middle frame member 75 carries two flanges, namely, a middle front mounting flange 175 and a middle rear mounting flange 275, each of which extends to the right on the exterior side of the middle tank 103 forming the middle frame member 75 of the right frame 70. The front mounting flange 171 and the middle front mounting flange 175 have complementary mounting slots 93 and 94 provided therein which extend from a blind end to an opening on the right which slots 93 and 94 are to receive the studs 91 and 92 to permit the external radiator 78 to be securely bolted to the right frame 70 between the front mounting flange 171 on the front frame member 71 and the middle front mounting flange 175 on the middle frame member 75. In a similar manner, each of the other external radiators 79, 80 and 81 are adapted to be removably bolted to the right frame 70 externally to the right side of the internal radiator 100. Similarly to radiator 78, the exterior radiator 81 spans between the front mounting flange 171 and the middle mounting flange 175. Each external radiator 79 and 80 spans between the middle frame member 75 and the rear frame member 73 by being mounted between the rear mounting flange 173 of the frame member 73 and the middle rear mounting flange 275 of the middle frame member 75.

Figure 14:
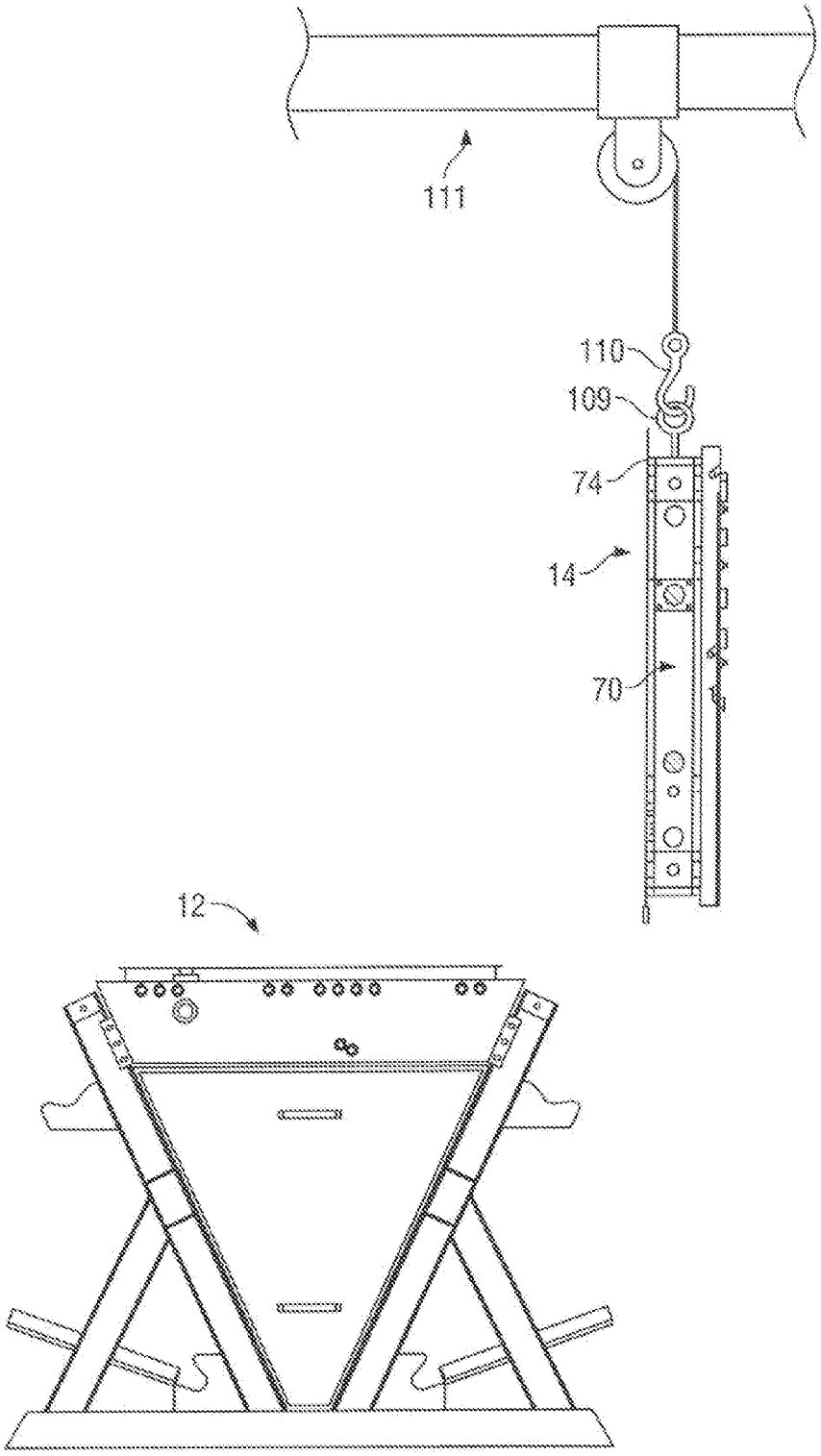
FIGS. 14 to 20 are schematic front views of the support pedestal structure of FIG. 7 and a right frame assembly showing the relative movement in coupling of the right frame assembly to the support pedestal structure from an uncoupled orientation as seen in FIG. 14 to a coupled orientation as seen in FIG. 20.
Figure 15:
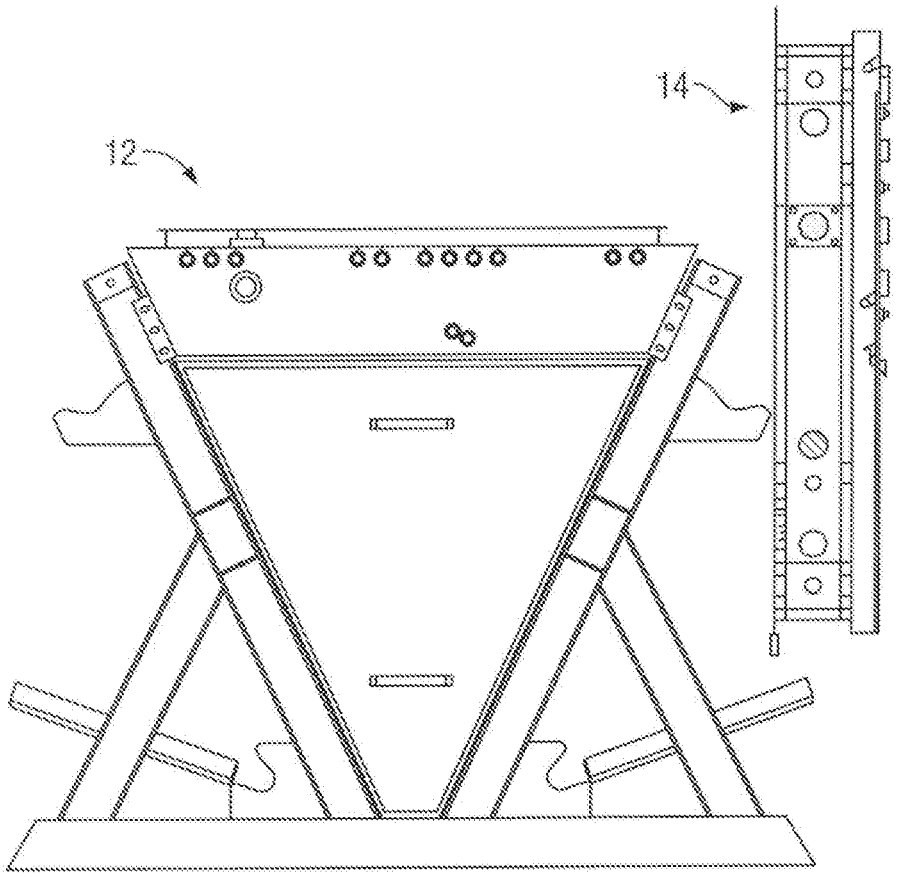

Reference is made to FIG. 14 which illustrates the right frame assembly 14 as comprising a unitary element and integral unit including as coupled together the right frame 70 with its interior radiator and exterior radiators. The right frame assembly 14 as such an integral unit may be separately removed from and coupled to the pedestal structure 12 in a manner as now described with reference to FIGS. 14 to 20. As schematically illustrated in FIG. 14, a pair of front to rear rigid eyelet support members 109 (of which only one is shown in FIG. 14) are removably rigidly secured to the top frame member 74 for engagement by a hook 110 shown in FIG. 14 of a schematically illustrated hoist crane structure 111 provided for positioning the right frame assembly 14 relative to the support pedestal structure 12, as for relative up and down, left to right, and forward or back movement of each hook relative to the support pedestal structure 12. The hoist crane structure 111 may comprise, for example, a portable crane or a fixed overhead crane. Preferably, the eyelet support members 109 are located on the right frame assembly 14 that the right frame assembly 14 is disposed vertically when hung from the hooks 110.

Figure 16:
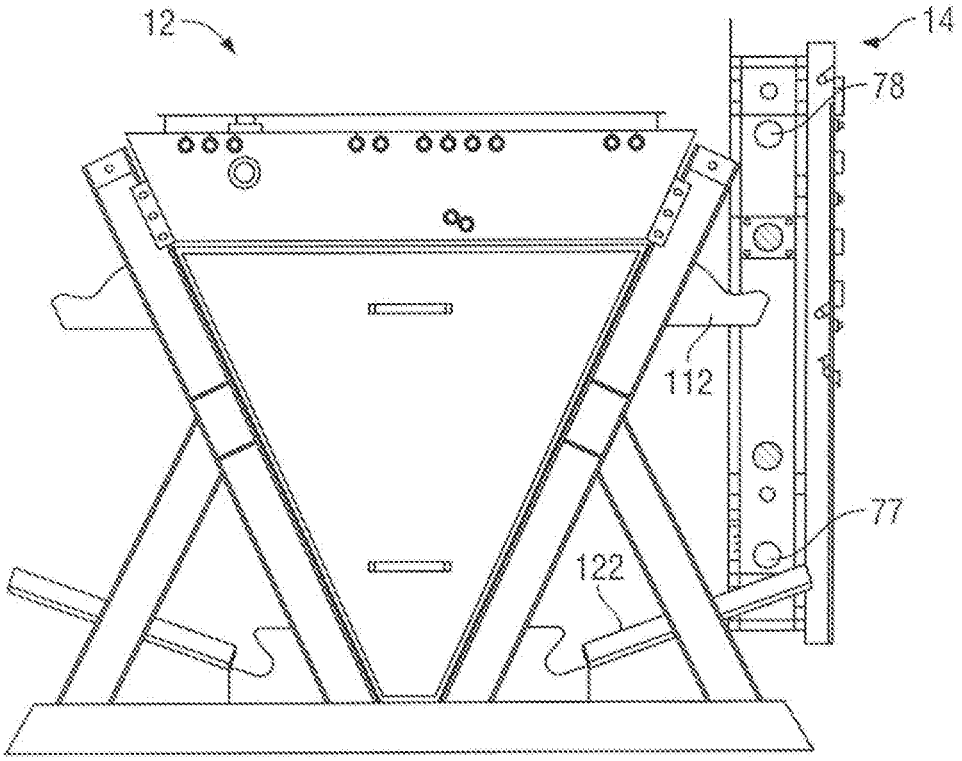

For ease of illustration the rigid eyelet support members 109, the hook 110 and the hoist crane structure 111 are only shown in FIG. 14 and not in FIGS. 15 to 20, however, they are to be understood to be utilized towards supporting the weight of the right frame assembly 14 and moving it to the relative positions shown in each of FIGS. 14 to 20. From the position of FIG. 14, the right frame assembly 14 is moved downwardly to the position shown in FIG. 15 closer to the support pedestal structure 12. FIG. 16 illustrates the right frame assembly 14 as having been moved such that its front and rear lower guide members 77 are located vertically above the front and back guiding members 122 of the front and rear lower guide arms structures 120 which extend laterally from the right side of the pedestal structure 12. The right frame assembly 14 is in FIG. 16 located front to rear relative the pedestal structure 12 such that the front end of the front lower guide member 77 is rearward of the vertical arm 182 of the front guiding member 122 and the rear end of the rear lower guide member 77 is forward of the similar vertical arm 128 of the rear guiding member 122. From the position of FIG. 16, the right frame assembly 14 is lowered vertically to the position of FIG. 17 in which each of the front and rear lower guide members 77 first engage the camming surface 123 of the front and rear lower arms of guiding members 122. Subsequently, from the position of FIG. 17 with subsequent vertical lowering of the upper end of the right frame assembly 14, each of the front and rear lower guide members 77 engages the camming surface 123 of the respective front and rear lower arms of angle iron members 170 and each is guided and cammed by such engagement so as to slide downwardly and towards the interior, that is, to the left from the position in FIG. 17 to the position in FIG. 18 and subsequently to the position of FIG. 19.

Figure 17:
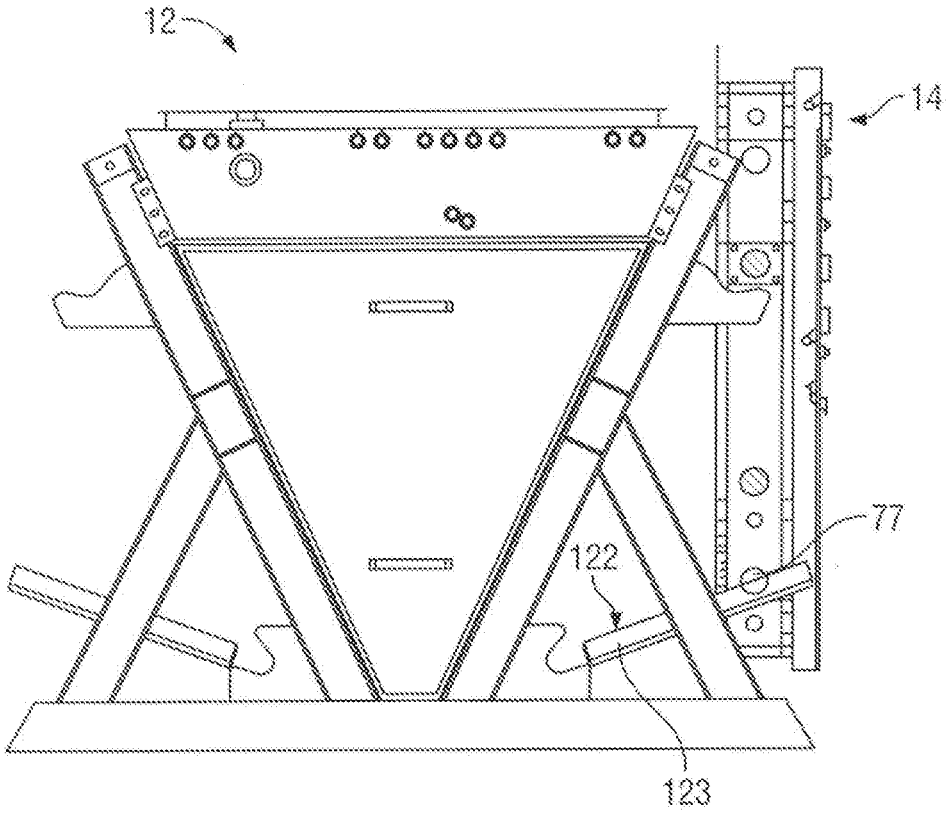
Figure 18:
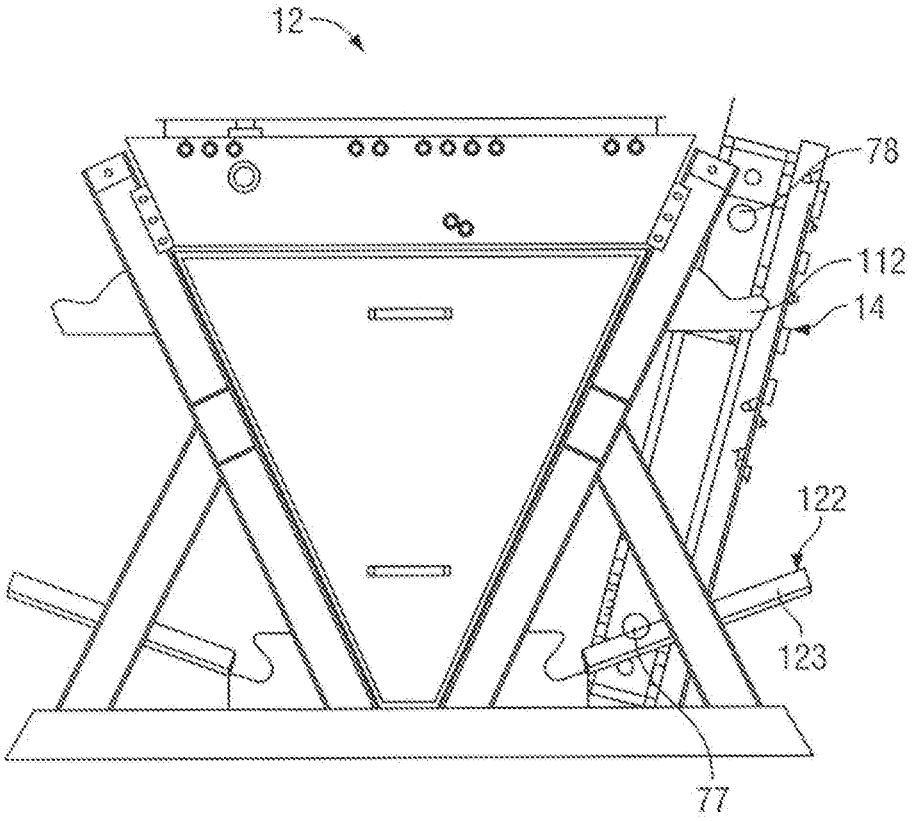

As seen in FIG. 18, the front and rear upper guide member 78 is disposed vertically above the front and rear right upper guide arm 112. With further lowering of the upper end of the right frame assembly 14, the front and rear lower guide members 77 continue to be guided downwardly and towards the interior along the lower camming surfaces 123 and the front and rear upper guide members 78 comes to be proximate to and first engaged on the camming surface 113 of the front and rear upper guide arms 112. From the position of FIG. 19, with further downward movement of the upper end of the right frame assembly 14, the front and rear lower guide members 77 comes to be engaged within the front and rear lower recesses 124 recess in the front and rear plates 120 simultaneously with the front and rear upper guide members 78 becoming received in the front and rear upper recesses 114 of the front and rear upper guide arms 112. It is to be appreciated that the right frame assembly 14 as moved downwardly through the positions of FIG. 14 to FIG. 20 is maintained in an appropriate horizontal position such that the engagement and camming between the lower guide arms 77 and the lower guide arm structures 120 occur simultaneously at both the front and rear, and such that the engagement and camming between the upper guide arms 112 and the upper guide members 78 also occur simultaneously at both the front and the rear.

Figure 19:
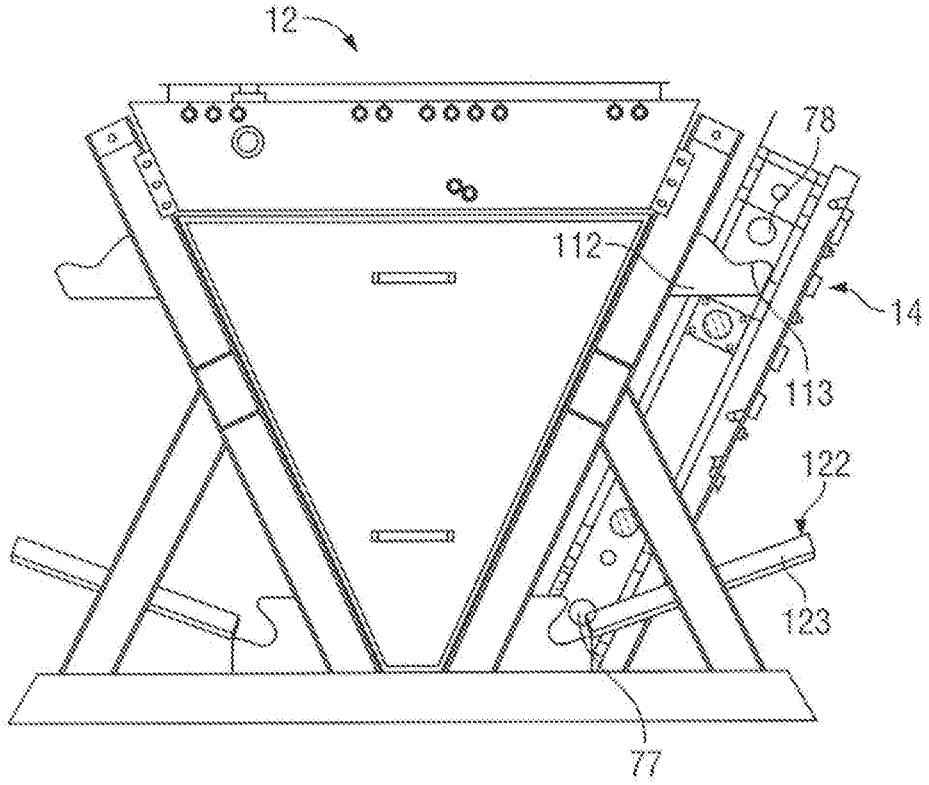

In movement from the position of FIG. 17 to the position of FIG. 19, while there is engagement and camming between the lower guide arms 77 and the camming surfaces 123 on the respective horizontal arms 126 of guiding members 122, the right frame assembly 14 is guided to remain centered front to rear relative the pedestal structure 12 with the front end of the front lower guide member 77 cammed by the vertical arm 127 of the front guiding member 122 to be rearward of the vertical arm 127 of the front guiding member 122 and the rear end of the rear lower guide member 77 cammed by the vertical arm 127 of the front guiding member 122 to be forward of the vertical arm 127 of the rear guiding member 122.

Figure 20:
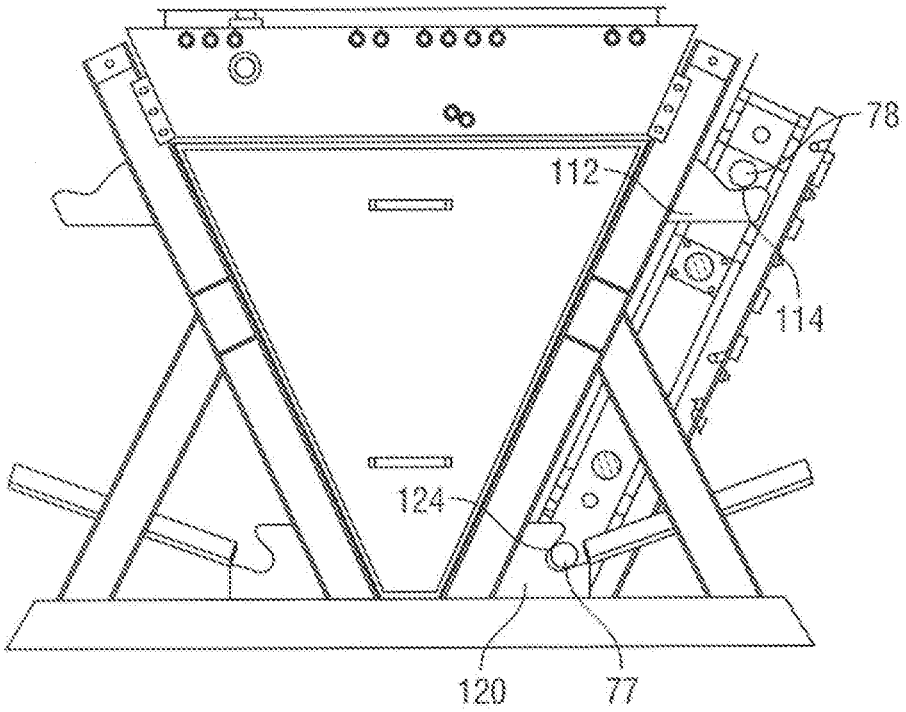

In the position as illustrated in FIG. 20, the right frame assembly 14 is stably supported on the pedestal structure 12 under the weight of the right frame assembly 14 urging the respective front and rear upper and lower support members into the respective upper and lower recesses against removal. Nevertheless, in the position of FIG. 20 preferably the right frame assembly 14 is fixed to the pedestal structure 12 preferably by the use of various fasteners such as bolts and the like, not shown. In the position as illustrated in FIG. 20, portions of the right frame 70 closely engage with the frame members forming the right side cage 51 and the right frame 70 is to be fixedly secured to the right side cage 50 as by the use of bolt members, not shown, for example, securing the top frame member 74 of the right frame 70 to the top frame member 23 of the right side cage and the bottom frame 72 of the right frame 70 to the bottom left side member 25 of the right side cage 50. Rather than use removable bolts, other fastening devices can be used such as releasable latching devices which may become latched merely by entry of a support members into its respective recess.

For removal of the right frame assembly 14 from the pedestal structure 12, the process may be reversed as, for example, in sequence from the position of FIG. 20 to the position of FIG. 14. Once the right frame assembly 14 is secured to the pedestal structure 12, various hosing connections may be made between each of the radiators 100, 78, 79 80 and 81 carried on the right frame assembly 14 and various hosing via which fluid is to be coupled to flow internally through each radiator.

The left frame assembly 15 is adapted to be fixedly secured to or removed from the pedestal structure 12 in an analogous manner to that described with the right frame assembly 15.

While not necessary, as can be seen in FIG. 1, an optional expansion tank 130 may be provided with different separate compartments as to serve as an expansion tank for different of the radiators and to be suitably coupled thereto.

Figure 12:
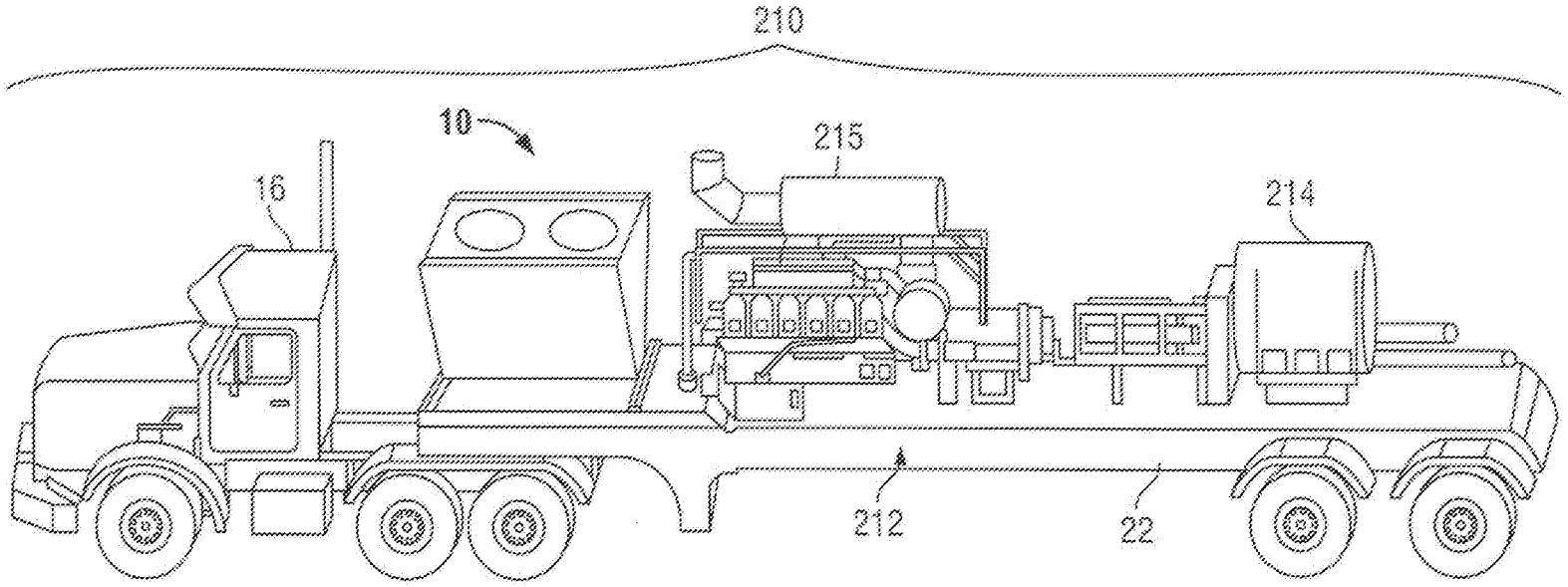
FIG. 12 is a schematic pictorial view illustrating a heat exchanger apparatus in accordance with the present invention as mounted on a frac truck.

As seen in FIG. 12, a heat exchanger apparatus 10 in accordance with the present invention is shown as mounted on the trailer bed of a trailer 212 of a modular mobile pump unit 210 carrying a diesel motor 215 for driving a pump 214 adapted for use in hydraulic fractioning operations to pump high pressure fluid into the ground in a known manner as, for example, disclosed in U.S. Pat. No. 7,845,413 to Shamoine, issued Dec. 7, 2010 and U.S. Patent publication No. 2014/0056729 to Pawlick, filed Aug. 21, 2012, the disclosures of which is incorporated herein by reference.

As is known with such arrangements, the different radiators carried on the heat exchanger apparatus 10 are desired to be provided for different purposes. For example, in the particular configurations, the major interior radiators 100 may act as primary cooling radiators for the diesel motor 215. The exterior radiators 78, 79, 80 and 81 may provide separate oil cooling radiators as, for example, to separately cool various elements such as inter coolers and transmissions driving the pump 214.

Such a mobile pump unit 210 as illustrated in FIG. 12 as often illustrated under conditions in which dust, dirt and other debris come to adhere to the tubes of the radiators reducing their performance and requiring periodic cleaning. Advantageously, the open interior 22 of the pedestal structure 12 may be accessed via the front opening 63 or the rear opening 64 by removal of the front access door 64 and/or the rear access door 66 as can be useful for entry of air, water and steam cleaning nozzles and personnel to handle the same.

Operation of the heat exchanger apparatus 10 under harsh conditions can require periodic replacement or repair of each of the individual radiators, or access to various of these radiators. In accordance with the present invention, the capability of removing each of the right frame assembly 14 and the left frame assembly 15 as an integral unit provides substantial advantages for relatively prompt servicing and repair of a heat exchanger apparatus 10 with a damaged radiator as by the replacement of either of the right frame assembly 14 or the left frame assembly 15 by a complementary replacement assembly or by removal of either of the right frame assembly 14 or the left frame assembly for ease of repair or changing of any one of the individual radiators with respective assembly separate from the support pedestal structure 12.

The particular arrangement of the guide arms on the support pedestal structure 12 and the guide members on each of the frame assemblies 14 and 15 provides for hoisting and movement of each of the right frame assembly 14 and the left frame assembly 15 relative to the pedestal structure 12 reducing the need for a person to position themselves in a hazardous position near to the heat exchanger apparatus 10. Thus, by mere use of a mechanized hoist crane structure 111, the right frame assembly 14 and the left frame assembly 15 can be supported and moved without personnel in a position where they may come to be harmed should support of the right frame assembly 14 or the left frame assembly by the hoist crane structure 111 fail. The apparatus 10 provides for safe coupling and uncoupling of the right frame assembly 14 and the left frame assembly assemblies 14 and 15. Preferably, personnel need not position themselves proximate to the apparatus 10 until such time as each of the right frame assembly 14 or the left frame assembly 15 is securely held on the apparatus 10 by the guide members on the assemblies 14 and 15 being securely engaged with the guide arms on the support pedestal structure 12.

Figure 26:
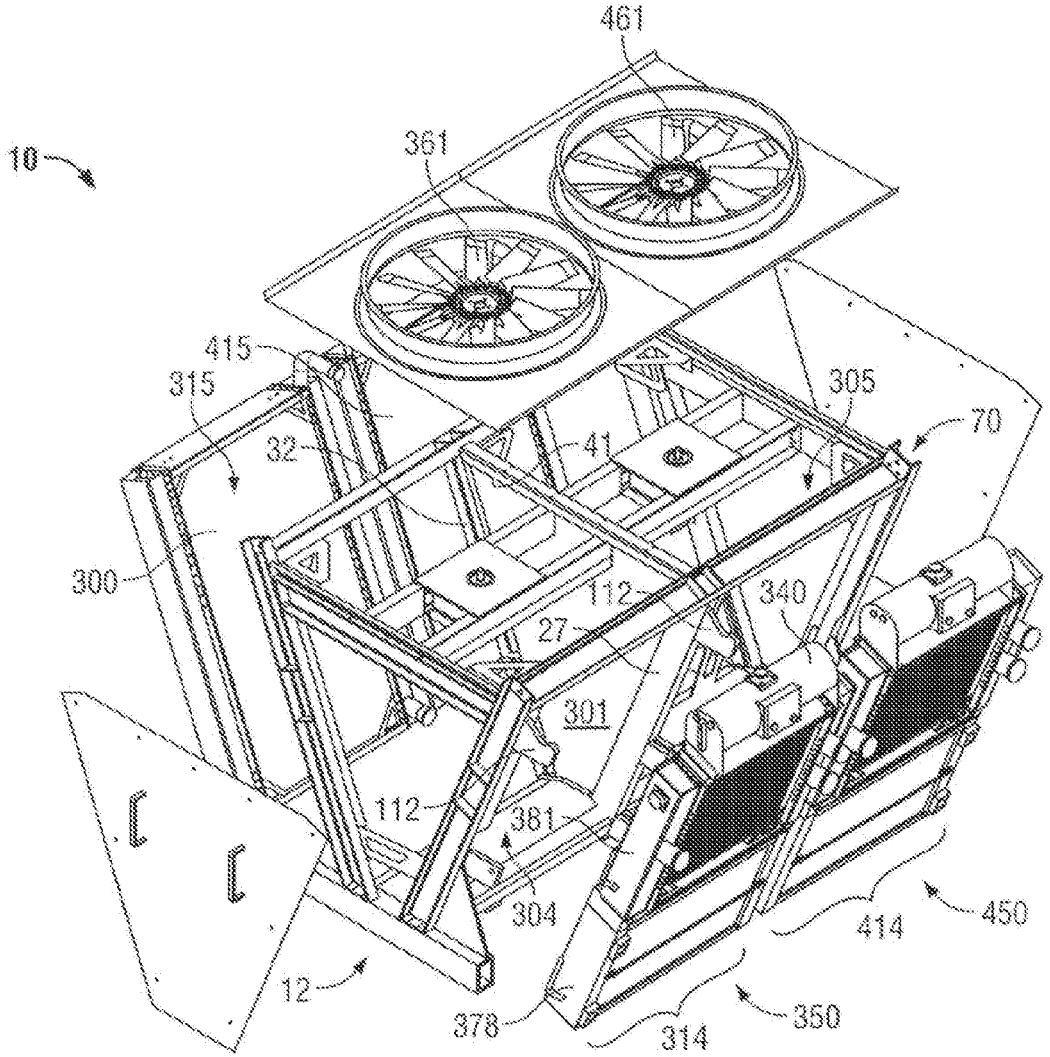
FIG. 26 is a schematic exploded pictorial view of a heat exchanger apparatus in accordance with a second embodiment of the present invention.

Reference is made to FIG. 26 which illustrates a second embodiment of a heat exchanger apparatus 10 in accordance with the present invention. The heat exchanger apparatus 10 of FIG. 25 has many similarities to the heat exchanger apparatus 10 of FIG. 6 and similar reference numerals are used to refer to similar elements. As seen in FIG. 25, the heat exchanger apparatus 10 includes a pedestal structure 12 which has close similarities to those shown in FIG. 6. One significant difference is that in FIG. 25, the middle panel 301 is attached extending vertically to join the right side middle frame member 27 and the left side middle frame 32 with the top middle frame member 41 so as to divide the interior 22 into a forward compartment 304 and a rear compartment 305. In the embodiment of FIG. 26, on the right side of the pedestal structure 12, there are provided two separate right frame assemblies, namely, a front right frame assembly 314 and a rear right frame assembly 414, each of which is independently mountable and removable from the pedestal structure 12. Similarly, on the left side of the pedestal structure 12, there are provided two separate left frame assemblies, namely, a front left frame assembly 315 and a rear left frame assembly 415. Each of the front left frame assembly 315 and the rear left frame assembly 415 is independently mountable and removable from the pedestal structure 12.

The front right frame assembly 314 carries at its top an expansion tank 340, below the expansion tank 340, a charge air cooler 381 and below the cooler 381, a radiator 378 which may serve as an oil cooler. The front left frame 315 assembly is shown as carrying a single radiator 300. Each of the cooler 381 and radiators would have a pair of headers, a core and inlet and outlet ports such that they may be connected to respective inlet and outlet conduits to receive air or fluid to be cooled and returned to an internal combustion engine, not shown. The radiators are adapted for internal liquid flow therethrough as by the circulation of a liquid internally therethrough. The charge air cooler 381 receives compressed air for the engine is to be passed internally between its tanks through its core to exchange heat with atmospheric air extending externally through its core.

The embodiment of FIG. 26 effectively provides two side by side heat exchangers, namely, a front heat exchanger 350 and a rear heat exchanger 450 which can be operated independently by independent operation of the respective front fan 361 or rear fan 461. The heat exchanger 10 illustrated in FIG. 26 is adapted for powering two diesel engines with the front heat exchanger 350 to independently cool a first engine and the rear heat exchanger 450 to independently cool a second engine. For example, the first heat exchanger 350 may be used to provide a radiator 315 and an oil cooler 378 and a charge air cooler 381.

In the embodiment of FIG. 26, each of the frame assemblies 314, 414, 315 and 415 comprises a unitary element and integral unit to be coupled to the pedestal structure 12. In FIG. 25, for ease of illustration, upper guide arms 112 are shown secured to the right side front frame member 26 and the right side middle frame member 27. A similar pair of upper guide arms, not shown, are to be provided with one on the right side rear frame member 24 and a second also on the right side middle frame member 27 as to support the right rear frame assembly 414. In the embodiment of FIG. 25, upper guide members 78 are provided on either side of the front right frame assembly 314 to engage on the upper guide arms 112. Lower guide arm structures are not shown on FIG. 25. In a simple arrangement, the frame assembly 414 is first hung with the upper guide members 78 engaged on the upper guide arms 112 to support the weight of the frame assembly 414 and thereafter the lower end of the frame assembly 414 is pivoted towards the interior and secured to the right interior frame 70.

Figure 27:
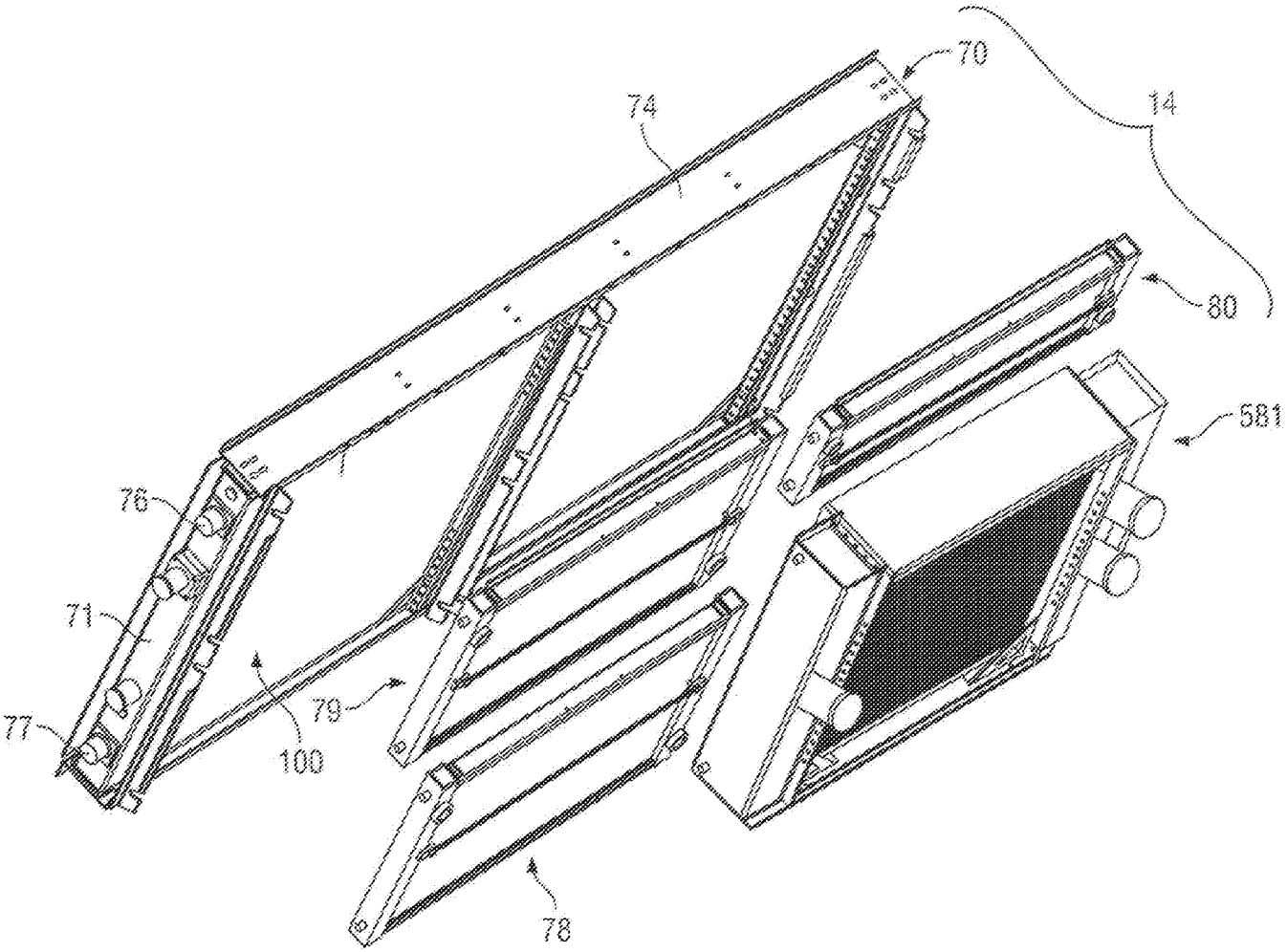
FIG. 27 is a schematic exploded pictorial view showing a right frame assembly similar to that shown in FIG. 21.

Reference is made to FIG. 27 which illustrates a third embodiment of a right frame assembly for a heat exchanger apparatus in accordance with another embodiment of the present invention. FIG. 27 illustrates a perspective view of a right frame assembly 14 identical to that illustrated in FIG. 21, however, with one exception. The one exception is that the radiator in FIG. 21 has been replaced by a charge air cooler 581. The right frame assembly 14 of FIG. 27 is to be used in substitution for the right frame assembly 14 in FIG. 6 in which a center panel 301 is provided to be secured as in the manner of the embodiment of FIG. 26 to close the interior between the right side middle frame member 27 and the left side middle frame member 32 so as to divide the interior into a front compartment and a rear compartment. In such an arrangement, the charge air cooler 581 achieves heat exchange as a function of the air being drawn by the rear fan 61 through the rear air compartment 304. In accordance with the embodiment of FIG. 27, a controller, not shown, is provided to independently control the relative speeds of operations of the two fans 61 and 61. By independently controlling the operation of the speed of the two fans 61 and 61, the extent to which the charge air cooler 581 may cool the charge air for the engine, to some extent, be controlled separate from the extent of cooling of fluid in the radiators, at least those radiators which in whole or in part, receive cooling by reason of atmospheric air drawn through the front air compartment. Such ability to selectively control the extent of that heat exchange may be provided to the charge air cooler 581 separate from other radiators or oil coolers can be advantageous under various circumstances which can arise in the operation of a diesel engine.

While a preferred use of a heat exchanger apparatus in accordance with the present invention is in the context of cooling an engine as, for example, for driving a pump used in hydraulic fractioning, the present invention is not so limited. A heat exchanger apparatus in accordance with the present invention may be used in any situation where heat exchange is desired whether heating or cooling. A heat exchanger apparatus in accordance with the present invention wherever used has the advantage of ease of accessibility for cleaning and ease of replacement and maintenance of the various radiators by removing each of the right frame assembly 14 or the left frame assembly 15 as an integral unit.

Many modifications and variations of the invention will now occur to persons skilled in the art. For a definition of the invention, reference is made to the following claims.

I claim:

1. A heat exchanger apparatus comprising:

a rigid support pedestal structure having a top, a bottom, a right side a left side, a front and a back, the pedestal structure comprising a plurality of frame members forming the pedestal structure with an open interior, the frame members defining a top air flow opening through the frame members through the top, a right side air flow opening through the frame members through the right side and a left side air flow opening through the frame members through the left side, a right frame assembly removably coupled to the pedestal structure on the right side of the pedestal structure across the right side air flow opening, a left frame assembly, removably coupled to the pedestal structure on the left side of the pedestal structure across the left side air flow opening, the right frame assembly comprising a rigid right frame with peripheral right frame members defining a right opening therebetween from an interior side of the right frame to an exterior side of the right frame, the right frame assembly further comprising at least one air to liquid or air to air right radiator each mounted to the right frame across the right opening, wherein with the right frame assembly removably coupled to the pedestal structure across the right side air flow opening, air flowing through the right opening of the right frame exchanges heat with a respective fluid within each right radiator, the left frame assembly comprising a rigid left frame with peripheral left frame members defining a left frame opening therebetween from an interior side of the left frame to an exterior side of the left frame, the left frame assembly further comprising at least air to liquid or air to air left radiator each mounted to the left frame across the opening for air flow through the left frame opening to exchange heat with a respective fluid within each left radiator, wherein with the left frame assembly removably coupled to the pedestal structure across the left side air flow opening, air flowing through the left opening of the left frame exchanges heat with fluid within each left radiator, wherein without disassembly of the pedestal structure, the right frame assembly, as an integral unit including the right frame with each right radiator fixedly secured to the right frame, is removable from and couplable to the pedestal structure, wherein without disassembly of the pedestal structure, the left frame assembly, as an integral unit including the left frame assembly with each left radiator fixedly secured to the left frame assembly, is removable from and couplable to the pedestal structure;

the right side air flow opening having an exterior face directed downwardly towards the right side;

the right frame assembly when mounted to the pedestal structure is disposed at an angle to the vertical with an upper portion of the right frame outwardly relative to a lower portion of the right frame assembly, a pair of front to rear spaced upper right guide members on the upper portion of the right frame assembly, a pair of front to rear spaced upper right guide arms on the pedestal structure extending laterally outwardly from the right side, each upper right guide arm having upper right-registry surfaces, the upper right registry surfaces on the upper right guide arms when engaged with the upper right guide members locate the upper portion of the right frame assembly against movement laterally and against movement downwardly, a pair of front to rear spaced lower right guide members on the lower portion of the right frame assembly, a pair of front to rear spaced lower right guide arms on the pedestal structure extending laterally outwardly from the right side to laterally beyond the upper right guide arms, each lower right guide arm having lower right registry surfaces and an upwardly directed lower right camming surface, the lower right camming surface extending from a lateral outer end to a lateral inner end, the lower right camming surface extending downwardly as it extends inwardly from the outer end to the inner end, the lower right camming surface at its inner end merging into the lower right registry surfaces, the lower right camming surfaces of the lower right guide arms when engaged by the lower right guide members urge the lower right guide members of the right frame assembly downwardly and laterally inwardly towards the pedestal support the right side into the lower right registry surfaces, the lower right registry surfaces on the lower right guide arms when engaged with the lower right guide members locate the lower portion of the right frame assembly against movement laterally inwardly to the right and against movement downwardly, when the upper right guide members are engaged with the upper right registry surfaces on the upper right guide arms and the lower right guide arms are engaged with the lower right registry surfaces on lower right guide members, the right frame assembly is in a coupled position removably mounted to the pedestal structure disposed at an angle to the vertical with the upper portion of the right frame assembly outwardly relative to the lower portion of the right frame assembly.

2. The heat exchanger apparatus as claimed in claim 1 wherein the flame members are elongate frame members forming an open matrix.

3. The heat exchanger apparatus as claimed in claim 2 wherein right side air flow opening is rectangular and the left side air flow opening is rectangular, the right frame is rectangular and the left frame is rectangular.

4. The heat exchanger apparatus as claimed in claim 3 wherein the top air flow opening has a cross-sectional area to provide air flow therethrough as may be required to supply air simultaneously to each right radiator and each left radiator.

5. The heat exchanger apparatus as claimed in claim 4 wherein the bottom, the front and the back of the pedestal structure are closed to air flow into or out of the interior of the pedestal structure.

6. The heat exchanger apparatus as claimed in claim 5 wherein the frame members define a front access opening through the frame members through the front and a front access door which closes the front access opening to air flow when closed and provides access through the front access opening to the interior of the pedestal structure when opened.

7. The heat exchanger apparatus as claimed in claim 6 wherein the frame members define a rear access opening through the frame members through the back and a rear access door which closes the rear access opening to air flow when closed and provides access through the rear access opening to the interior of the pedestal structure when opened.

8. The heat exchanger apparatus as claimed in claim 7 wherein an air moving fan is mounted to the pedestal structure to draw air through the top air flow opening from the interior, thereby drawing atmospheric air inwardly simultaneously through the right opening of the right frame and the left opening of the left frame.

9. The heat exchanger apparatus as claimed in claim 8 wherein:

the right frame assembly comprising a plurality of heat exchangers selected from the group consisting of air to liquid radiators and air to air radiators.

10. The heat exchanger apparatus as claimed in claim 9 wherein the right radiators comprise at least one interior right radiator mounted to the right frame on an interior side of the right frame opening and at least one exterior right radiator, mounted to the right frame on an exterior side of the right frame opening such that at least some air flowing into the interior of the pedestal structure inwardly through the right frame opening passes firstly the exterior right radiator then subsequently through the interior right radiator.

11. The heat exchanger apparatus as claimed in claim 10 wherein the left frame assembly further comprising a plurality of heat exchangers selected from the group consisting of air to liquid radiators and air to air radiators.

12. The heat exchanger apparatus as claimed in claim 11 wherein the left radiators comprise at least one interior left radiator mounted to the left frame on an interior side of the left frame opening and at least one exterior left radiator, mounted to the left frame on an exterior side of the left frame opening such that at least some air flowing into the interior of the pedestal structure inwardly through the left frame opening passes firstly the exterior left radiator then subsequently through the interior left radiator.

13. The heat exchanger apparatus as claimed in claim 1 wherein when the lower right guide arms are engaged with the lower right camming surfaces on the lower right guide members but not engaged with the lower right registry surfaces then the upper right guide arms are spaced from the upper right registry surfaces on the upper right guide arms.

14. The heat exchanger apparatus as claimed in claim 13 wherein the lower right guide arms extending laterally outwardly to the right so that the right frame assembly while uncoupled to the pedestal and while suspended and hanging vertically from a crane is lowered from above the pedestal vertically downwardly relative the pedestal to place the lower right guide members in engagement with the lower right caroming surfaces of the lower right guide arms.

15. The heat exchanger apparatus as claimed in claim 14 wherein with the right frame assembly while uncoupled to the pedestal and while suspended and hanging from the crane with the lower right guide members in engagement with the lower right camming surfaces of the lower right guide arms on further lowering of the right frame assembly with the crane the lower right camming surfaces guide the lower right guide members laterally inwardly into the lower right registry surfaces.

16. The heat exchanger apparatus as claimed in claim 15 wherein with the right frame assembly while uncoupled to the pedestal and while suspended and hanging from the crane with the lower right guide members in the lower right registry surfaces on further lowering of the right frame assembly with the crane the lower right registry surfaces engage the lower right guide members and journal the lower right guide members guiding pivoting of the right frame assembly relative the pedestal about the lower right guide members toward placing the upper right guide members into the in the lower right registry surfaces.

17. A method of use of a heat exchanger apparatus comprising: providing the heat exchanger apparatus, comprising;

a rigid support pedestal structure having a top, a bottom, a right side a left side, a front and a back, the pedestal structure comprising a plurality of frame members forming the pedestal structure with a substantially open interior, the frame members defining a top air flow opening through the frame members through the top, a right side air flow opening through the frame members through the right side and a left side air flow opening through the frame members through the left side, a right frame assembly removably coupled to the pedestal structure on the right side of the pedestal structure across the right side air flow opening, a left frame assembly, removably coupled to the pedestal structure on the left side of the pedestal structure across the left side air flow opening, the right frame assembly comprising a rigid right frame with peripheral right frame members defining a right opening therebetween from an interior side of the right frame to an exterior side of the right frame, the right frame assembly further comprising at least one air to liquid or air to air right radiator each mounted to the right frame across the right opening, wherein with the right frame assembly removably coupled to the pedestal structure across the right side air flow opening, air flowing through the right opening of the right frame exchanges heat with a respective fluid within each right radiator, the left frame assembly comprising a rigid left frame with peripheral left frame members defining a left frame opening therebetween from an interior side of the left frame to an exterior side of the left frame, the left frame assembly further comprising at least air to liquid or air to air left radiator each mounted to the left frame across the opening for air flow through the left frame opening to exchange heat with a respective fluid within each left radiator, wherein with the left frame assembly removably coupled to the pedestal structure across the left side air flow opening, air flowing through the left opening of the left frame exchanges heat with fluid within each left radiator, wherein without disassembly of the pedestal structure, the right frame assembly, as an integral unit including the right frame with each right radiator fixedly secured to the right frame, is removable from and couplable to the pedestal structure, wherein without disassembly of the pedestal structure, the left frame assembly, as an integral unit including the left frame assembly with each left radiator fixedly secured to the left frame assembly, is removable from and couplable to the pedestal structure, the right side air flow opening having an exterior face directed downwardly towards the right side;

the right frame assembly when mounted to the pedestal structure is disposed at an angle to the vertical with an upper portion of the right frame assembly outwardly relative to a lower portion of the right frame assembly, a pair of front to rear spaced upper right guide members on the upper portion of the right frame assembly, a pair of front to rear spaced upper right guide arms on the pedestal structure extending laterally outwardly from the right side, each upper right guide arm having upper right registry surfaces, the upper right registry surfaces on the upper right guide arms when engaged with the upper right guide members locate the upper portion of the right frame assembly against movement laterally and against movement downwardly, a pair of front to rear spaced lower right guide members on the lower portion of the right frame, assembly a pair of front to rear spaced lower right guide arms on the pedestal structure extending laterally outwardly from the right side to laterally beyond the upper right guide arms, each lower right guide arm having lower right registry surfaces and an upwardly directed lower right camming surface, the lower right camming surface extending from a lateral outer end to a lateral inner end, the lower right camming surface extending downwardly as it extends inwardly from the outer end to the inner end, the lower right camming surface at its inner end merging into the lower right registry surfaces, the lower right camming surfaces of the lower right guide arms when engaged by the lower right guide members urge the lower right guide members of the right frame assembly downwardly and laterally inwardly towards the pedestal support right side into the lower right registry surfaces, the lower right registry surfaces on the lower right guide arms when engaged with the lower right guide members locate the lower portion of the right frame assembly against movement laterally inwardly to the right and against movement downwardly, when the upper right guide members are engaged with the upper right registry surfaces on the upper right guide arms and the lower right guide arms are engaged with the lower right registry surfaces on lower right guide members, the right frame assembly is in a coupled position removably mounted to the pedestal structure disposed at an angle to the vertical with the upper portion of the right frame assembly outwardly relative to the lower portion of the right frame, the method comprising coupling the right frame assembly to the pedestal by the steps of:

a. in an initial position suspending the right frame assembly with a crane from the upper portion of the right frame assembly to hanging vertically above the pedestal with the upper portion of the right frame above the lower portion of the right frame assembly and with the lower right guide members vertically above the lower right camming surfaces of the lower right guide arms, b. in a first lowering step lowering the right frame assembly from the initial position with the crane vertically downwardly relative the pedestal until the lower right guide members are in engagement with the lower right camming surfaces of the lower right guide arms in a first engagement position, and c. in a second lowering step following the first lowering step lowering the upper portion of the right frame assembly with the crane from the first engagement position downwardly relative the pedestal while guiding the lower right guide members by engagement with the lower right camming surfaces of the lower right guide arms into the lower right registry surfaces in a first registry position.

18. The method as claimed in claim 17 further including the step of:

d. following the second lowering step in a third lowering step lowering the upper portion of the right frame assembly with the crane from the first registry position downwardly relative the pedestal while the lower right guide members are in engagement with the lower right registry surfaces of the lower right guide arms to pivot the right frame assembly relative the pedestal about the lower right guide members until the upper right guide arms engage the upper right registry surfaces.

19. The heat exchanger as claimed in claim 1 wherein the left side air flow opening having an exterior face directed downwardly towards the left side;

the left frame assembly when mounted to the pedestal structure is disposed at an angle to the vertical with an upper portion of the left frame outwardly relative to a lower portion of the left frame assembly, a pair of front to rear spaced upper left guide members on the upper portion of the left frame assembly, a pair of front to rear spaced upper left guide arms on the pedestal structure extending laterally outwardly from the left side, each upper left guide arm having upper left registry surfaces, the upper left registry surfaces on the upper left guide arms when engaged with the upper left guide members locate the upper portion of the left frame assembly against movement laterally and against movement downwardly, a pair of front to rear spaced lower left guide members on the lower portion of the left frame assembly, a pair of front to rear spaced lower left guide arms on the pedestal structure extending laterally outwardly from the left side to laterally beyond the upper left guide arms, each lower left guide arm having lower left registry surfaces and an upwardly directed lower left camming surface, the lower left camming surface extending from a lateral outer end to a lateral inner end, the lower left camming surface extending downwardly as it extends inwardly from the outer end to the inner end, the lower left camming surface at its inner end merging into the lower left registry surfaces, the lower left camming surfaces of the lower left guide arms when engaged by the lower left guide members urge the lower left guide members of the left frame assembly downwardly and laterally inwardly towards the pedestal support the left side into the lower left registry surfaces, the lower left registry surfaces on the lower left guide arms when engaged with the lower left guide members locate the lower portion of the left frame assembly against movement laterally inwardly to the left and against movement downwardly, when the upper left guide members are engaged with the upper left registry surfaces on the upper left guide arms and the lower left guide arms are engaged with the lower left registry surfaces on lower left guide members, the left frame assembly is in a coupled position removably mounted to the pedestal structure disposed at an angle to the vertical with the upper portion of the left frame assembly outwardly relative to the lower portion of the left frame assembly.

* * * * *